US010117794B2

(12) United States Patent
Bourgraf et al.

(10) Patent No.: US 10,117,794 B2
(45) Date of Patent: Nov. 6, 2018

(54) METHODS AND SYSTEMS FOR AUTOMATICALLY ARTICULATING COTS

(71) Applicant: Ferno-Washington, Inc., Wilmington, OH (US)

(72) Inventors: Joseph G. Bourgraf, Maineville, OH (US); Brian Michael Magill, Cincinnati, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 1 day.

(21) Appl. No.: 15/300,427

(22) PCT Filed: Apr. 3, 2015

(86) PCT No.: PCT/US2015/024192

§ 371 (c)(1),
(2) Date: Sep. 29, 2016

(87) PCT Pub. No.: WO2015/153936

PCT Pub. Date: Oct. 8, 2015

(65) Prior Publication Data

US 2017/0172819 A1 Jun. 22, 2017

Related U.S. Application Data

(60) Provisional application No. 61/975,441, filed on Apr. 4, 2014.

(51) Int. Cl.

| | |
|---|---|
| ***A61G 1/013*** | (2006.01) |
| ***A61G 1/02*** | (2006.01) |
| ***A61G 1/056*** | (2006.01) |

(52) U.S. Cl.

CPC ..... *A61G 1/013* (2013.01); *A61G 1/02* (2013.01); *A61G 1/0212* (2013.01); (Continued)

(58) Field of Classification Search

CPC ..... A61G 1/02; A61G 1/025; A61G 1/0256; A61G 1/0262; A61G 1/0268; (Continued)

(56) References Cited

U.S. PATENT DOCUMENTS 3,752,527 A * 8/1973 Ferneau ..... A61G 1/052 108/120
3,759,565 A * 9/1973 Ferneau ..... A61G 1/0562 108/82

(Continued)

FOREIGN PATENT DOCUMENTS

| | | |
|---|---|---|
| EP | 2347745 A1 | 7/2011 |
| WO | 0170161 A1 | 9/2001 |
| WO | 2014015255 A2 | 1/2014 |

OTHER PUBLICATIONS

European Patent Office International Search Report and Written Opinion dated Nov. 2, 2015 in reference to co-pending International Application No. PCT/US2015/024192 filed Apr. 3, 2015.

(Continued)

*Primary Examiner* — Gregory A Blankenship
(74) *Attorney, Agent, or Firm* — Dinsmore & Shohl LLP

(57) ABSTRACT

A power ambulance cot having a cot control system operably connected to a cot actuation system to control independent raising and lowering of front and back legs thereof, and which detects a presence of a signal requesting a change in elevation of a support frame thereof and causes the cot actuation system to raising or the lowering of the front and/or back legs automatically upon detecting a condition during loading/unloading a patient from an emergency vehicle or transporting the patient up or down an esculator and methods thereafter are disclosed.

7 Claims, 13 Drawing Sheets

(52) U.S. Cl.
CPC ..... *A61G 1/0243* (2013.01); *A61G 1/0256* (2013.01); *A61G 1/0262* (2013.01); *A61G 1/0287* (2013.01); *A61G 1/0562* (2013.01); *A61G 2203/12* (2013.01); *A61G 2203/16* (2013.01); *A61G 2203/20* (2013.01); *A61G 2203/40* (2013.01); *A61G 2203/42* (2013.01); *A61G 2203/726* (2013.01); *A61G 2205/60* (2013.01)

(58) Field of Classification Search
CPC .. A61G 1/0275; A61G 1/0287; A61G 1/0562; A61G 2203/40; A61G 2203/42; A61G 2205/60
USPC ..... 296/20
See application file for complete search history.

(56) References Cited

U.S. PATENT DOCUMENTS 3,826,528 A * 7/1974 East ..... A61G 1/0562 296/20
4,037,871 A 7/1977 Bourgraf et al.
4,921,295 A 5/1990 Stollenwerk
5,084,922 A * 2/1992 Louit ..... A61G 1/0562 296/20
9,314,384 B2 * 4/2016 Watanabe ..... A61G 1/0237
9,456,938 B2 * 10/2016 Blickensderfer .... A61G 1/0212
9,789,020 B2 * 10/2017 Blickensderfer .... A61G 1/0212
2004/0133981 A1 7/2004 Walkingshaw
2006/0075558 A1 4/2006 Lambarth et al.
2006/0082176 A1 * 4/2006 Broadley ..... A61G 1/0293 296/20
2006/0195987 A1 9/2006 Walkingshaw
2007/0000057 A1 * 1/2007 Ward ..... A61G 1/0293 5/611
2009/0031498 A1 * 2/2009 Girard ..... A61G 7/015 5/617
2009/0165207 A1 7/2009 Reed et al.
2009/0172883 A1 * 7/2009 Benedict ..... A61G 1/0293 5/620
2010/0083442 A1 * 4/2010 Nash ..... A61G 1/0567 5/620
2011/0266821 A1 * 11/2011 Goto ..... A61G 1/048 296/20
2012/0275896 A1 * 11/2012 Magill ..... A61G 1/056 414/800
2013/0168987 A1 * 7/2013 Valentino ..... A61G 7/018 296/20
2014/0197654 A1 * 7/2014 Valentino ..... A61G 1/013 296/20
2014/0265181 A1 * 9/2014 Lambarth ..... A61G 1/017 280/28.5
2015/0001871 A1 * 1/2015 Watanabe ..... A61G 1/0237 296/20
2015/0061240 A1 * 3/2015 Segawa ..... A61G 5/107 280/5.28
2015/0216747 A1 * 8/2015 Valentino ..... A61G 1/0212 5/610
2015/0313780 A1 * 11/2015 Valentino ..... A61G 1/0562 5/611
2016/0000617 A1 * 1/2016 Magill ..... A61G 1/0212 296/20
2016/0128880 A1 * 5/2016 Blickensderfer .... A61G 1/0212 296/20
2016/0287454 A1 * 10/2016 Magill ..... A61G 1/0212
2016/0304007 A1 * 10/2016 Bourgraf ..... B60N 2/42736
2017/0172819 A1 * 6/2017 Bourgraf ..... A61G 1/013
2017/0367915 A1 * 12/2017 Blickensderfer ..... A61G 1/013
2018/0028383 A1 * 2/2018 Stryker ..... A61G 7/1046

OTHER PUBLICATIONS

Chinese Office Action dated Aug. 1, 2017, pertaining to serial No. 201580021784.9.

* cited by examiner

METHODS AND SYSTEMS FOR AUTOMATICALLY ARTICULATING COTS

TECHNICAL FIELD

The present disclosure is generally related to automated systems, and is specifically directed to automated systems for powered emergency patient transporters or cots.

BACKGROUND

There are a variety of emergency patient transporters or cots in use today. Such emergency cots may be designed to transport and load bariatric patients into an ambulance.

For example, the PROFlexX® cot, by Ferno-Washington, Inc. of Wilmington, Ohio U.S.A., is one such patient transporter embodied as a manually actuated cot that may provide stability and support for loads of about 700 pounds (about 317.5 kg). The PROFlexX® cot includes a patient support portion that is attached to a wheeled undercarriage. The wheeled under carriage includes an X-frame geometry that can be transitioned between nine selectable positions. One recognized advantage of such a cot design is that the X-frame provides minimal flex and a low center of gravity at all of the selectable positions. Another recognized advantage of such a cot design is that the selectable positions may provide better leverage for manually lifting and loading bariatric patients.

Another example of an emergency patient transporter or cot designed for bariatric patients, is the POWERFlexx+ Powered Cot, by Ferno-Washington, Inc. The POWERFlexx+ Powered Cot includes a battery powered actuator that may provide sufficient power to lift loads of about 700 pounds (about 317.5 kg). One recognized advantage of such a cot design is that the cot may lift a bariatric patient up from a low position to a higher position, i.e., an operator may have reduced situations that require lifting the patient.

A further variety of an emergency patient transporter is a multipurpose emergency roll-in cot having a patient support stretcher that is removably attached to a wheeled undercarriage or transporter. The patient support stretcher, when removed for separate use from the transporter, may be shuttled around horizontally upon an included set of wheels. One recognized advantage of such a cot design is that the stretcher may be separately rolled into an emergency vehicle such as station wagons, vans, modular ambulances, aircrafts, or helicopters, where space and reducing weight is a premium.

Another advantage of such a cot design is that the separated stretcher may be more easily carried over uneven terrain and out of locations where it is impractical to use a complete cot to transfer a patient. Example of such cots can be found in U.S. Pat. Nos. 4,037,871, 4,921,295, and International Publication No. WO01701611.

Although the foregoing multipurpose emergency roll-in cots have been generally adequate for their intended purposes, they have not been satisfactory in all aspects. For example, the foregoing cots are loaded into ambulances according to loading processes that require at least one operator to support the load of the cot for a portion of the respective loading process.

SUMMARY

The embodiments described herein are directed to automated systems for versatile multipurpose emergency roll-in cots which may provide improved management of the cot weight, improved balance, and/or easier loading at any cot height, while being loaded via rolling into various types of rescue vehicles, such as ambulances, vans, station wagons, aircrafts and helicopters.

In one embodiment disclosed herein is a method of automatically articulating a powered ambulance cot to load a patient into an emergency vehicle having a loading surface. The method comprises supporting the patient on the power ambulance cot. The cot comprises a support frame provided with a pair of front load wheels and supporting the patient, a pair of front legs each having a front wheel and an intermediate load wheel, a pair of back legs each having a back wheel, a cot actuation system having a front actuator which moves together the pair of front legs and which interconnects the support frame and the pair of front legs, and a back actuator which moves together the pair of back legs and which interconnects the support frame and the pair of back legs, and a cot control system operably connected to the cot actuation system to control raising and lowering of the pair of front legs and the pair of back legs independently, and which detects a presence of a signal requesting a change in elevation of said support frame to cause the cot actuation system to move either or both pairs of the front and back wheels relative to the support frame via the raising or the lowering of the pair of front legs and/or the pair of back legs. The method comprises raising the support frame of the powered ambulance cot to a height which places the front load wheels above the loading surface of the emergency vehicle via the cot control system detecting presence of a signal requesting the support frame be raised and activating the cot actuation system. The method comprises rolling the powered ambulance cot towards the emergency vehicle until the front load wheels are over the loading surface. The method comprises lowering the support frame until the front load wheels contact the loading surface via the cot control system detecting the presence of a signal requesting the support frame be lowered and activating the cot actuation system. The method comprises automatically raising the pair of front legs relative to the support frame until the front wheel of each of the front legs is at or above the loading surface via the cot control system detecting both presence of a signal requesting the front legs be raised and front load wheels being in contact with the loading surface and activating the cot actuation system. The method comprises rolling the powered ambulance cot further onto the loading surface until the intermediate load wheel of each of the front legs is on the loading surface; raising the pair of back legs relative to the support frame until the back wheels are at or above the loading surface via the cot control system detecting presence of a signal requesting the back legs be raised and activating the cot actuation system; and rolling the powered ambulance cot further onto the loading surface until the back wheel of each of the back legs is on the loading surface.

In another embodiment disclosed herein is a method of automatically articulating a powered ambulance cot to unload a patient from an emergency vehicle having a loading surface. The method comprises supporting the patient on the power ambulance cot. The cot comprises a support frame provided with a pair of front load wheels and supporting the patient, a pair of front legs each having a front wheel and an intermediate load wheel, a pair of back legs each having a back wheel, a cot actuation system having a front actuator which moves together the pair of front legs and which interconnects the support frame and the pair of front legs, and a back actuator which moves togather the pair of back legs and which interconnects the support frame and the pair of back legs, and a cot control system operably connected to the cot actuation system to control raising and lowering of the pair of front legs and the pair of back legs independently, and which detects a presence of a signal requesting a change in elevation of said support frame to cause the cot actuation system to move either or both pairs of the front and back wheels relative to the support frame via the raising or the lowering of the pair of front legs and/or the pair of back legs. The method comprises rolling the powered ambulance cot on the loading surface until only the back wheel of each of the back legs is off the loading surface. The method comprises automatically lowering the pair of back legs relative to the support frame until the back wheels are supporting the cot below the loading surface via the cot control system detecting both presence of a signal requesting the back legs be extended and the back wheel of each of the back legs being off the loading surface and activating the cot actuation system. The method comprises rolling the powered ambulance cot further off the loading surface until both the front wheel and intermediate load wheel of each of the front legs is off the loading surface but with the front load wheels still in contact with the loading surface. The method comprises lowering the pair of front legs relative to the support frame until the front wheel of each of the front legs supporting the support frame below the loading surface via the cot control system detecting presence of a signal requesting the front legs be extended and activating the cot actuation system; and rolling the powered ambulance cot away from the emergency vehicle.

In still another embodiment disclosed herein is a method of automatically articulating a powered ambulance cot to transport a patient up or down a moving esculator. The method comprises supporting the patient on the powered ambulance cot. The cot comprises a support frame provided with a pair of front load wheels and supporting the patient, a pair of front legs each having a front wheel and an intermediate load wheel, a pair of back legs each having a back wheel, a cot actuation system having a front actuator which moves together the pair of front legs and which interconnects the support frame and the pair of front legs, and a back actuator which moves togather the pair of back legs and which interconnects the support frame and the pair of back legs, and a cot control system operably connected to the cot actuation system to control raising and lowering of the pair of front legs and the pair of back legs independently, and which detects a presence of a signal requesting a change in elevation of said support frame to cause the cot actuation system to move either or both pairs of the front and back wheels relative to the support frame via the raising or the lowering of the pair of front legs and/or the pair of back legs. The method comprises rolling the cot onto the moving esculator, wherein the control system automatically retracts or extends the front legs to maintain the support frame level relative to gravity as the esculator moves up or down.

These and additional features provided by the embodiments of the present disclosure will be more fully understood in view of the following detailed description, in conjunction with the drawings.

BRIEF DESCRIPTION OF THE DRAWINGS

The following detailed description of specific embodiments of the present disclosures can be best understood when read in conjunction with the following drawings, where like structure is indicated with like reference numerals and in which.

Figure 1:
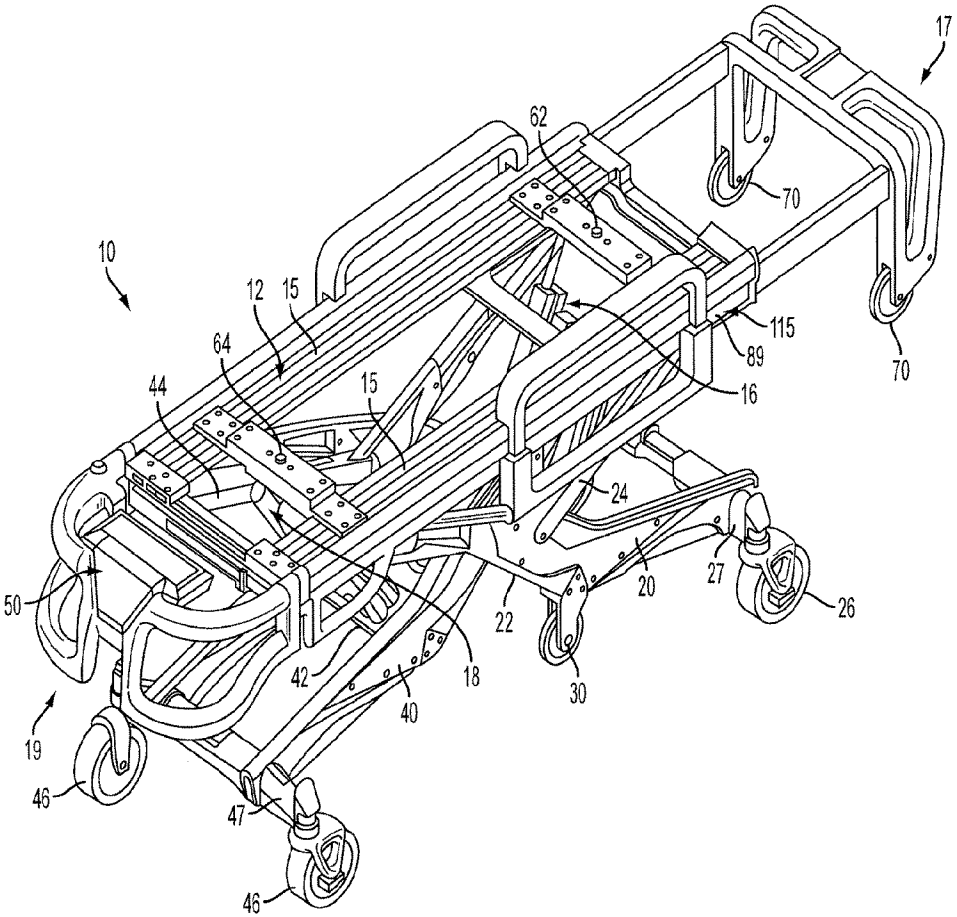
FIG. 1 is a perspective view depicting a cot according to one or more embodiments described herein.

The embodiments set forth in the drawings are illustrative in nature and not intended to be limiting of the embodiments described herein. Moreover, individual features of the drawings and embodiments will be more fully apparent and understood in view of the detailed description.

DETAILED DESCRIPTION

Referring to FIG. 1, a self-actuating, powered roll-in cot 10 for transporting a patient thereon and loading into an emergency transport vehicle is shown. The cot 10 comprises a support frame 12 comprising a front end 17, and a back end 19. As used herein, the front end 17 is synonymous with the term "loading end", i.e., the end of the cot 10 which is loaded first onto a loading surface. Conversely, as used herein, the back end 19 is the end of the cot 10 which is loaded last onto a loading surface, and is synonymous with the term "control end" which is the end providing a number of operator controls as discussed herein. Additionally it is noted, that when the cot 10 is loaded with a patient, the head of the patient may be oriented nearest to the front end 17 and the feet of the patient may be oriented nearest to the back end 19. Thus, the phrase "head end" may be used interchangeably with the phrase "front end," and the phrase "foot end" may be used interchangeably with the phrase "back end." Furthermore, it is noted that the phrases "front end" and "back end" are interchangeable. Thus, while the phrases are used consistently throughout for clarity, the embodiments described herein may be reversed without departing from the scope of the present disclosure. Generally, as used herein, the term "patient" refers to any living thing or formerly living thing such as, for example, a human, an animal, a corpse and the like.

Figure 2:
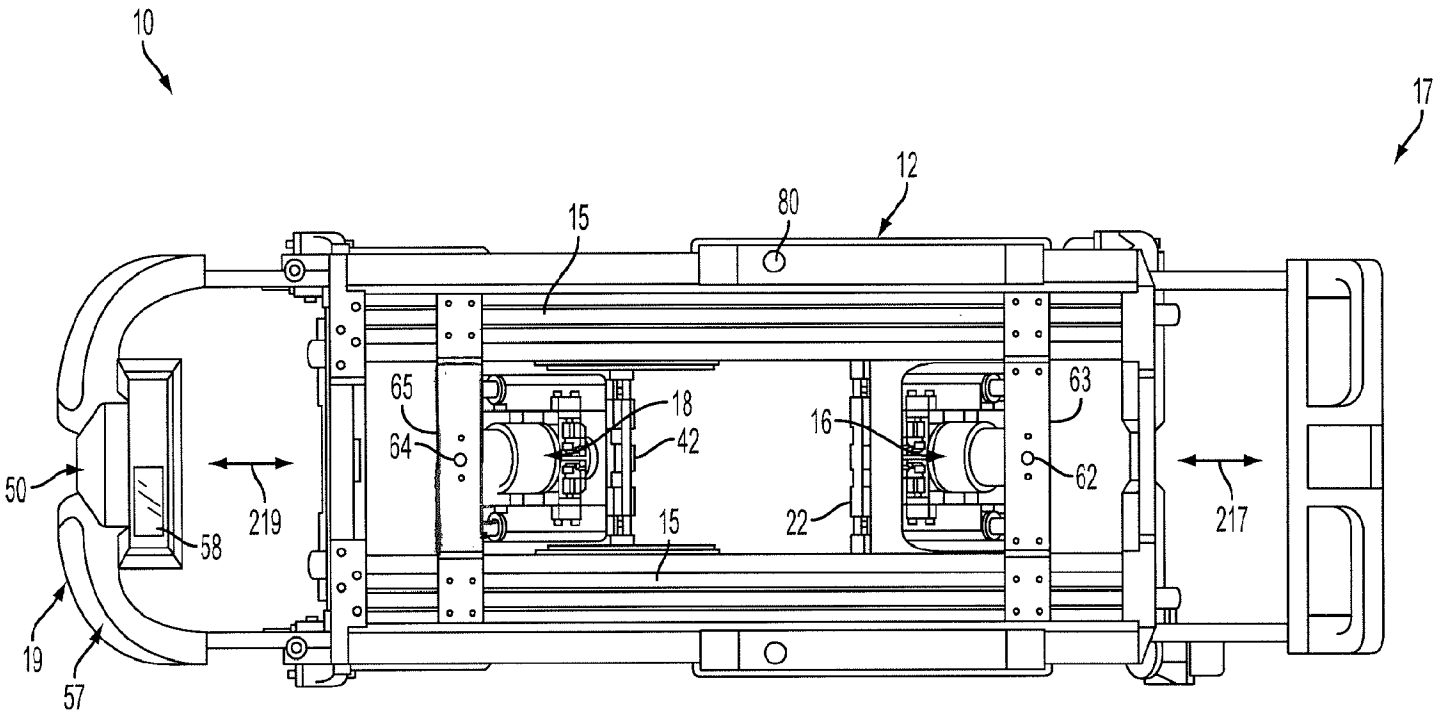
FIG. 2 is a top view depicting a cot according to one or more embodiments described herein.
Figure 3:
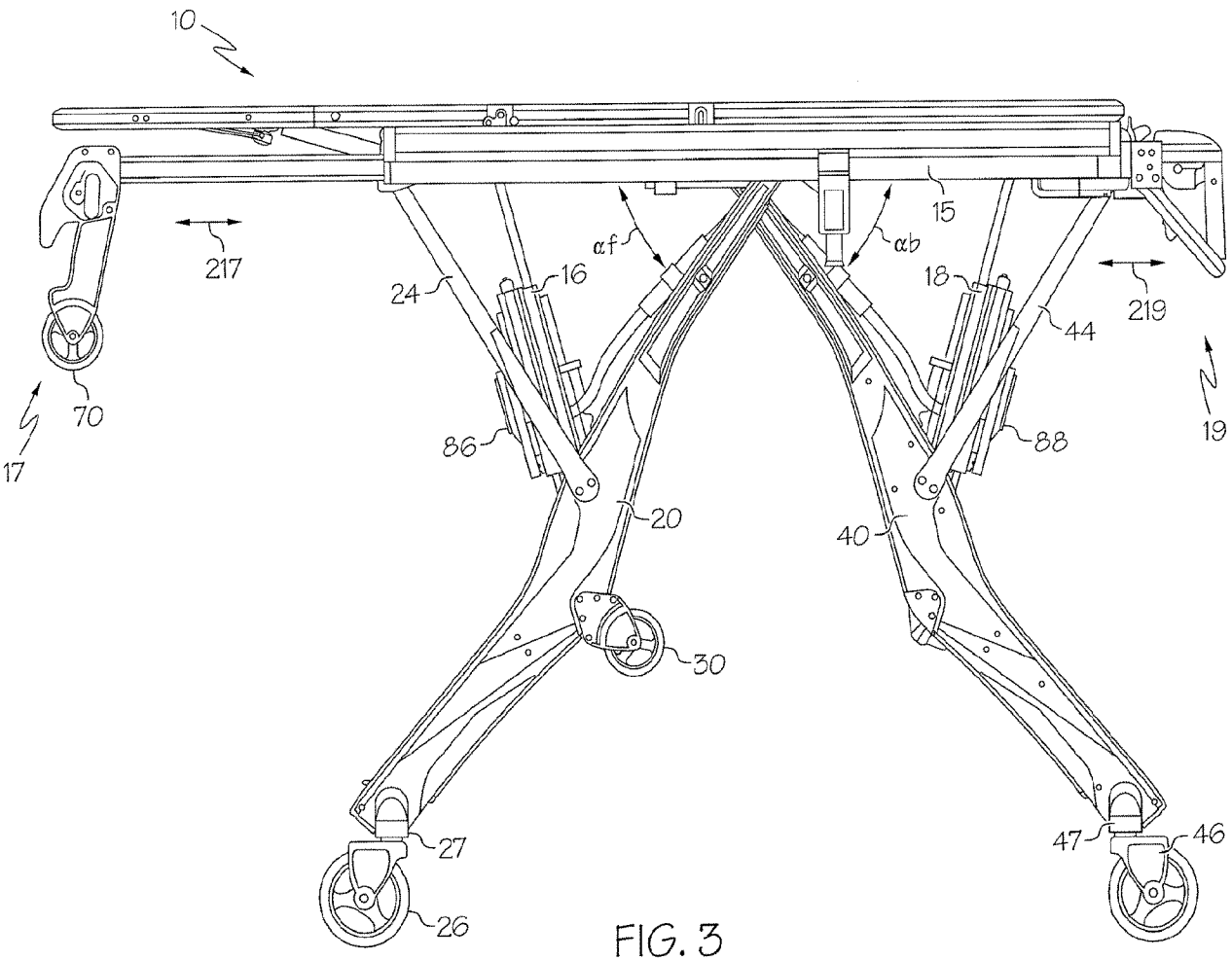
FIG. 3 is a side view depicting a cot according to one or more embodiments described herein.

Referring collectively to FIGS. 2 and 3, the front end 17 and/or the back end 19 may be telescoping. In one embodiment, the front end 17 may be extended and/or retracted (generally indicated in FIG. 2 by arrow 217). In another embodiment, the back end 19 may be extended and/or retracted (generally indicated in FIG. 2 by arrow 219). Thus, the total length between the front end 17 and the back end 19 may be increased and/or decreased to accommodate various sized patients.

Referring collectively to FIGS. 1-3, the support frame 12 may comprise a pair of substantially parallel lateral side members 15 extending between the front end 17 and the back end 19. Various structures for the lateral side members 15 are contemplated. In one embodiment, the lateral side members 15 may be a pair of spaced metal tracks. In another embodiment, the lateral side members 15 comprise an undercut portion 115 that is engageable with an accessory clamp (not depicted). Such accessory clamps may be utilized to removably couple patient care accessories such as a pole for an IV drip to the undercut portion 115. The undercut portion 115 may be provided along the entire length of the lateral side members to allow accessories to be removably clamped to many different locations on the roll-in cot 10.

Referring again to FIG. 1, the roll-in cot 10 also comprises a pair of retractable and extendible loading end legs or front legs 20 coupled to the support frame 12, and a pair of retractable and extendible control end legs or back legs 40 coupled to the support frame 12. The roll-in cot 10 may comprise any rigid material such as, for example, metal structures or composite structures. Specifically, the support frame 12, the front legs 20, the back legs 40, or combinations thereof may comprise a carbon fiber and resin structure. As is described in greater detail herein, the roll-in cot 10 may be raised to multiple heights by extending the front legs 20 and/or the back legs 40, or the roll-in cot 10 may be lowered to multiple heights by retracting the front legs 20 and/or the back legs 40. It is noted that terms such as "raise," "lower," "above," "below," and "height" are used herein to indicate the distance relationship between objects measured along a line parallel to gravity using a reference (e.g. a surface supporting the cot).

In specific embodiments, the front legs 20 and the back legs 40 may each be coupled to the lateral side members 15. As shown in FIGS. 4A-5E, the front legs 20 and the back legs 40 may cross each other, when viewing the cot from a side, specifically at respective locations where the front legs 20 and the back legs 40 are coupled to the support frame 12 (e.g., the lateral side members 15 (FIGS. 1-3)). As shown in the embodiment of FIG. 1, the back legs 40 may be disposed inwardly of the front legs 20, i.e., the front legs 20 may be spaced further apart from one another than the back legs 40 are spaced from one another such that the back legs 40 are each located between the front legs 20. Additionally, the front legs 20 and the back legs 40 may comprise front wheels 26 and back wheels 46 which enable the roll-in cot 10 to roll.

In one embodiment, the front wheels 26 and back wheels 46 may be swivel caster wheels or swivel locked wheels. As the roll-in cot 10 is raised and/or lowered, the front wheels 26 and back wheels 46 may be synchronized to ensure that the plane of the lateral side members 15 of the roll-in cot 10 and the plane of the wheels 26, 46 are substantially parallel.

Referring to FIGS. 1-3 and 6, the roll-in cot 10 may also comprise a cot actuation system 34 comprising a front actuator 16 configured to move the front legs 20 and a back actuator 18 configured to move the back legs 40. The cot actuation system 34 may comprise one unit (e.g., a centralized motor and pump) configured to control both the front actuator 16 and the back actuator 18. For example, the cot actuation system 34 may comprise one housing with one motor capable to drive the front actuator 16, the back actuator 18, or both utilizing valves, control logic and the like. Alternatively, as depicted in FIG. 1, the cot actuation system 34 may comprise separate units configured to control the front actuator 16 and the back actuator 18 individually. In this embodiment, the front actuator 16 and the back actuator 18 may each include separate housings with individual motors to drive each of the front actuator 16 and the back actuator 18.

The front actuator 16 is coupled to the support frame 12 and configured to actuate the front legs 20 and raise and/or lower the front end 17 of the roll-in cot 10. Additionally, the back actuator 18 is coupled to the support frame 12 and configured to actuate the back legs 40 and raise and/or lower the back end 19 of the roll-in cot 10. The roll-in cot 10 may be powered by any suitable power source. For example, the roll-in cot 10 may comprise a battery capable of supplying a voltage of, such as, about 24 V nominal or about 32 V nominal for its power source.

The front actuator 16 and the back actuator 18 are operable to actuate the front legs 20 and back legs 40, simultaneously or independently. As shown in FIGS. 4A-5E, simultaneous and/or independent actuation allows the roll-in cot 10 to be set to various heights. The actuators described herein may be capable of providing a dynamic force of about 350 pounds (about 158.8 kg) and a static force of about 500 pounds (about 226.8 kg). Furthermore, the front actuator 16 and the back actuator 18 may be operated by a centralized motor system or multiple independent motor systems.

In one embodiment, schematically depicted in FIGS. 1-3 and 6, the front actuator 16 and the back actuator 18 comprise hydraulic actuators for actuating the roll-in cot 10. In one embodiment, the front actuator 16 and the back actuator 18 are dual piggy back hydraulic actuators, i.e., the front actuator 16 and the back actuator 18 each forms a master-slave hydraulic circuit. The master-slave hydraulic circuit comprises four hydraulic cylinders with four extending rods that are piggy backed (i.e., mechanically coupled) to one another in pairs. Thus, the dual piggy back actuator comprises a first hydraulic cylinder with a first rod, a second hydraulic cylinder with a second rod, a third hydraulic cylinder with a third rod and a fourth hydraulic cylinder with a fourth rod. It is noted that, while the embodiments described herein make frequent reference to a master-slave system comprising four hydraulic cylinders, the master-salve hydraulic circuits described herein can include any even number of hydraulic cylinders.

Figure 6:
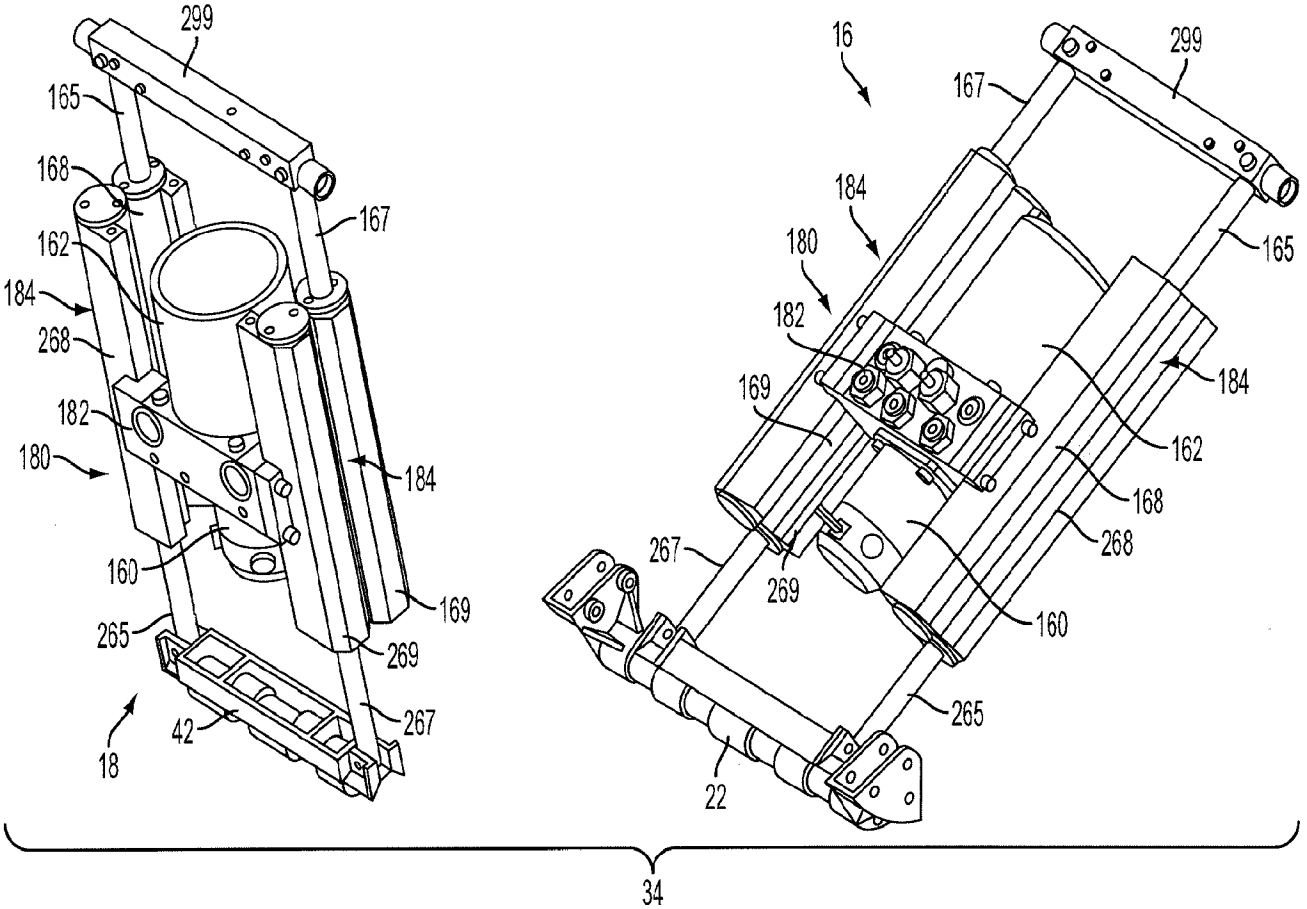
FIG. 6 schematically depicts an actuator system of a cot according to one or more embodiments described herein.

Referring to FIG. 6, the front actuator 16 and the back actuator 18 each comprises a rigid support frame 180 that is substantially "H" shaped (i.e., two vertical portions connected by a cross portion). The rigid support frame 180 comprises a cross member 182 that is coupled to two vertical members 184 at about the middle of each of the two vertical members 184. A pump motor 160 and a fluid reservoir 162 are coupled to the cross member 182 and in fluid communication. In one embodiment, the pump motor 160 and the fluid reservoir 162 are disposed on opposite sides of the cross member 182 (e.g., the fluid reservoir 162 disposed above the pump motor 160). Specifically, the pump motor 160 may be a brushed bi-rotational electric motor with a peak output of about 1400 watts. The rigid support frame 180 may include additional cross members or a backing plate to provide further rigidity and resist twisting or lateral motion of the vertical members 184 with respect to the cross member 182 during actuation.

Each vertical member 184 comprises a pair of piggy backed hydraulic cylinders (i.e., a first hydraulic cylinder and a second hydraulic cylinder or a third hydraulic cylinder and a fourth hydraulic cylinder) wherein the first cylinder extends a rod in a first direction and the second cylinder extends a rod in a substantially opposite direction. When the cylinders are arranged in one master-slave configuration, one of the vertical members 184 comprises an upper master cylinder 168 and a lower master cylinder 268. The other of the vertical members 184 comprises an upper slave cylinder 169 and a lower slave cylinder 269. It is noted that, while master cylinders 168, 268 are piggy backed together and extend rods 165, 265 in substantially opposite directions, master cylinders 168, 268 may be located in alternate vertical members 184 and/or extend rods 165, 265 in substantially the same direction.

Figure 7:
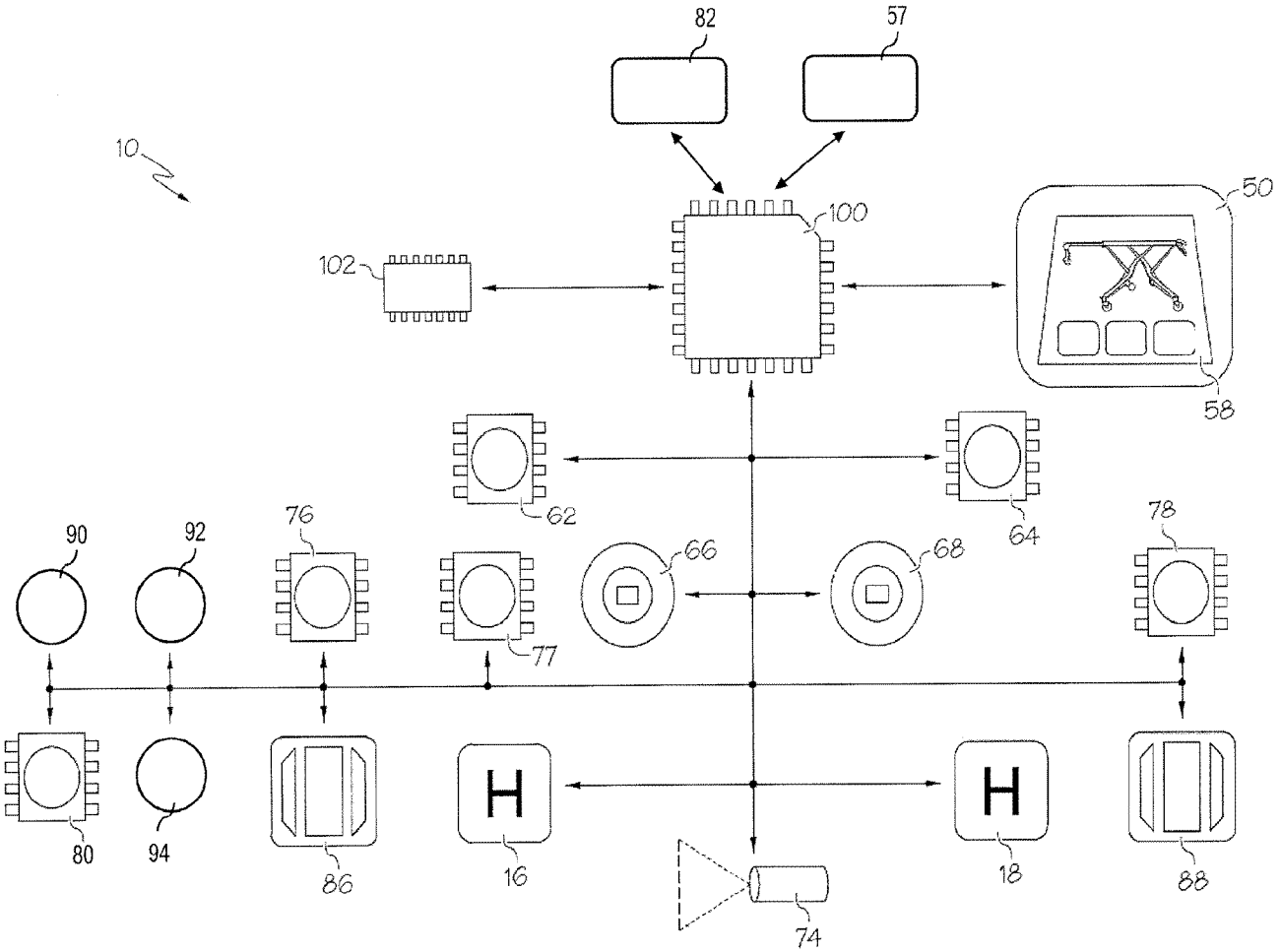
FIG. 7 schematically depicts a cot having an electrical system according to one or more embodiments described herein.

Referring now to FIG. 7, the control box 50 is communicatively coupled (generally indicated by the arrowed lines) to one or more processors 100. Each of the one or more processors can be any device capable of executing machine readable instructions such as, for example, a controller, an integrated circuit, a microchip, or the like. As used herein, the term "communicatively coupled" means that the components are capable of exchanging data signals with one another such as, for example, electrical signals via conductive medium, electromagnetic signals via air, optical signals via optical waveguides, and the like.

The one or more processors 100 can be communicatively coupled to one or more memory modules 102, which can be any device capable of storing machine readable instructions. The one or more memory modules 102 can include any type of memory such as, for example, read only memory (ROM), random access memory (RAM), secondary memory (e.g., hard drive), or combinations thereof. Suitable examples of ROM include, but are not limited to, programmable read-only memory (PROM), erasable programmable read-only memory (EPROM), electrically erasable programmable read-only memory (EEPROM), electrically alterable read-only memory (EAROM), flash memory, or combinations thereof. Suitable examples of RAM include, but are not limited to, static RAM (SRAM) or dynamic RAM (DRAM).

The embodiments described herein can perform methods automatically by executing machine readable instructions with the one or more processors 100. The machine readable instructions can comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored. Alternatively, the machine readable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

Referring collectively to FIGS. 2 and 7, a front actuator sensor 62 and a back actuator sensor 64 are configured to detect whether the front and back actuators 16, 18 respectively are either located in a first position, which situates each actuator closer relatively to an underside of a respective one of a pair of cross members 63, 65 (FIG. 2) or a second position, which situates each actuator further away from the respective one of the cross members 63, 65 relative to the first position, and communicate such detection to the one or more processors 100. In one embodiment, the front actuator sensor 62 and the back actuator sensor 64 are coupled to a respective one of the cross members 63, 65; however, other locations on the support frame 12 or configurations are contemplated herein. The sensors 62, 64 may be distance measuring sensors, string encoders, potentiometer rotary sensors, proximity sensors, reed switches, hall-effect sensors, combinations thereof or any other suitable sensor operable to detect when the front actuator 16 and/or back actuator 18 are either at and/or passed a first position and/or second position. In further embodiments, other sensors may be used with the front and back actuators 16, 18 and/or cross members 63, 65 to detect the weight of a patient disposed on the cot 10 (e.g., via strain gauges). It is noted that the term "sensor," as used herein, means a device that measures a physical quantity, state, or attribute and converts it into a signal which is correlated to the measured value of the physical quantity, state or attribute. Furthermore, the term "signal" means an electrical, magnetic or optical waveform, such as current, voltage, flux, DC, AC, sinusoidal-wave, triangular-wave, square-wave, and the like, capable of being transmitted from one location to another.

Referring collectively to FIGS. 3 and 7, the roll-in cot 10 can comprise a front angular sensor 66 and a back angular sensor 68 that are communicatively coupled to the one or more processors 100. The front angular sensor 66 and the back angular sensor 68 can be any sensor that measures actual angle or change in angle such as, for example, a potentiometer rotary sensor, hall-effect rotary sensor and the like. The front angular sensor 66 can be operable to detect a front angle $\alpha_f$ of a pivotally coupled portion of the front legs 20. The back angular sensor 68 can be operable to detect a back angle $\alpha_b$ of a pivotally coupled portion of the back legs 40. In one embodiment, front angular sensor 66 and back angular sensor 68 are operably coupled to the front legs 20 and the back legs 40, respectively. Accordingly, the one or more processors 100 can execute machine readable instructions to determine the difference between the front angle $\alpha_f$ and back angle $\alpha_b$ (angle delta). A loading state angle may be set to an angle such as about 20° or any other angle that generally indicates that the roll-in cot 10 is in a loading state (indicative of loading and/or unloading). Thus, when the angle delta exceeds the loading state angle the roll-in cot 10 may detect that it is in a loading state and perform certain actions dependent upon being in the loading state. Alternatively, distance sensors can be utilized to perform measurements analogous to angular measurements that determine the front angle $\alpha_f$ and back angle $\alpha_b$. For example, the angle can be determined from the positioning of the front legs 20 and/or the back legs 40 and relative to the lateral side members 15. For example, the distance between the front legs 20 and a reference point along the lateral side members 15 can be measured. Similarly, the distance between the back legs 40 and a reference point along the lateral side members 15 can be measured. Moreover, the distance that the front actuator 16 and the back actuator 18 are extended can be measured. Accordingly, any of the distance measurements or angular measurements described herein can be utilized interchangeably to determine the positioning of the components of the roll-in cot 10.

Additionally, it is noted that distance sensors may be coupled to any portion of the roll-in cot 10 such that the distance between a lower surface and components such as, for example, the front end 17, the back end 19, the front load wheels 70, the front wheels 26, the intermediate load wheels 30, the back wheels 46, the front actuator 16 or the back actuator 18 may be determined Referring collectively to FIGS. 3 and 7, the front end 17 may comprise a pair of front load wheels 70 configured to assist in loading the roll-in cot 10 onto a loading surface (e.g., the floor of an ambulance). The roll-in cot 10 may comprise a load end sensor 76 communicatively coupled to the one or more processors 100. The load end sensor 76 is a distance sensor operable to detect the location of the front load wheels 70 with respect to a loading surface (e.g., distance from the detected surface to the front load wheels 70). Suitable distance sensors include, but are not limited to, ultrasonic sensors, touch sensors, proximity sensors, or any other sensor capable to detecting distance to an object. In one embodiment, load end sensor 76 is operable to detect directly or indirectly the distance from the front load wheels 70 to a surface substantially directly beneath the front load wheels 70. Specifically, load end sensor 76 can provide an indication when a surface is within a definable range of distance from the front load wheels 70 (e.g., when a surface is greater than a first distance but less than a second distance), and which also is referred herein as the load end sensor 76 "seeing" or "sees" the loading surface.). Accordingly, the definable range may be set such that a positive indication is provided by load end sensor 76 when the front load wheels 70 of the roll-in cot 10 are in contact with a loading surface. Ensuring that both front load wheels 70 are on the loading surface may be important, especially in circumstances when the roll-in cot 10 is loaded into an ambulance at an incline.

The front legs 20 may comprise intermediate load wheels 30 attached to the front legs 20. In one embodiment, the intermediate load wheels 30 may be disposed on the front legs 20 adjacent the front cross beam 22 (FIG. 2) to which the front actuator 16 is mounted at a lower end (FIG. 6). As depicted by FIGS. 1 and 3, the control end legs 40 are not provided with any intermediate load wheels adjacent a back cross beam 42 to which the back actuator 18 is mounted at a lower end (FIG. 6).). The roll-in cot 10 may comprise an intermediate load sensor 77 communicatively coupled to the one or more processors 100. The intermediate load sensor 77 is a distance sensor operable to detect the distance between the intermediate load wheels 30 and the loading surface 500. In one embodiment, when the intermediate load wheels 30 are within a set distance of the loading surface, the intermediate load sensor 77 may provide a signal to the one or more processors 100. Although the figures depict the intermediate load wheels 30 only on the front legs 20, it is further contemplated that intermediate load wheels 30 may also be disposed on the back legs 40 or any other position on the roll-in cot 10 such that the intermediate load wheels 30 cooperate with the front load wheels 70 to facilitate loading and/or unloading (e.g., the support frame 12). For example, intermediate load wheels can be provided at any location that is likely to be a fulcrum or center of balance during the loading and/or unloading process described herein.

The roll-in cot 10 may comprise a back actuator sensor 78 communicatively coupled to the one or more processors 100. The back actuator sensor 78 is a distance sensor operable to detect the distance between the back actuator 18 and the loading surface. In one embodiment, back actuator sensor 78 is operable to detect directly or indirectly the distance from the back actuator 18 to a surface substantially directly beneath the back actuator 18, when the back legs 40 are substantially fully retracted (FIGS. 4, 5D, and 5E). Specifically, back actuator sensor 78 can provide an indication when a surface is within a definable range of distance from the back actuator 18 (e.g., when a surface is greater than a first distance but less than a second distance).

Referring still to FIGS. 3 and 7, the roll-in cot 10 may comprise a front drive light 86 communicatively coupled to the one or more processors 100. The front drive light 86 can be coupled to the front actuator 16 and configured to articulate with the front actuator 16. Accordingly, the front drive light 86 can illuminate an area directly in front of the front end 17 of the roll-in cot 10, as the roll-in cot 10 is rolled with the front actuator 16 extended, retracted, or any position there between. The roll-in cot 10 may also comprise a back drive light 88 communicatively coupled to the one or more processors 100. The back drive light 88 can be coupled to the back actuator 18 and configured to articulate with the back actuator 18. Accordingly, the back drive light 88 can illuminate an area directly behind the back end 19 of the roll-in cot 10, as the roll-in cot 10 is rolled with the back actuator 18 extended, retracted, or any position there between. The one or more processors 100 can receive input from any of the operator controls described herein and cause the front drive light 86, the back drive light 88, or both to be activated.

Referring collectively to FIGS. 1 and 7, the roll-in cot 10 may comprise a line indicator 74 communicatively coupled to the one or more processors 100. The line indicator 74 can be any light source configured to project a linear indication upon a surface such as, for example, a laser, light emitting diodes, a projector, or the like. In one embodiment, the line indicator 74 can be coupled to the roll-in cot 10 and configured to project a line upon a surface below the roll-in cot 10, such that the line is aligned with the intermediate load wheels 30. The line can run from a point beneath or adjacent to the roll-in cot 10 and to a point offset from the side of the roll-in cot 10. Accordingly, when the line indicator projects the line, an operator at the back end 19 of the can maintain visual contact with the line and utilize the line as a reference of the location of the center of balance of the roll-in cot 10 (e.g., the intermediate load wheels 30) during loading, unloading, or both.

The back end 19 may comprise operator controls 57 for the roll-in cot 10. As used herein, the operator controls 57 comprise the input components that receive commands from the operator and the output components that provide indications to the operator. Accordingly, the operator can utilize the operator controls 57 in the loading and unloading of the roll-in cot 10 by controlling the movement of the front legs 20, the back legs 40, and the support frame 12. The operator controls 57 may be included with a cot control system or control box 50 disposed on the back end 19 of the roll-in cot 10. For example, the control box 50 can be communicatively coupled to the one or more processors 100, which is in turn communicatively coupled to the front actuator 16 and the back actuator 18. The control box 50 can comprise a visual display component or graphical user interface (GUI) 58 configured to inform an operator whether the front and back actuators 16, 18 are activated or deactivated. The visual display component or GUI 58 can comprise any device capable of emitting an image such as, for example, a liquid crystal display, a touch screen, or the like.

Figure 8:
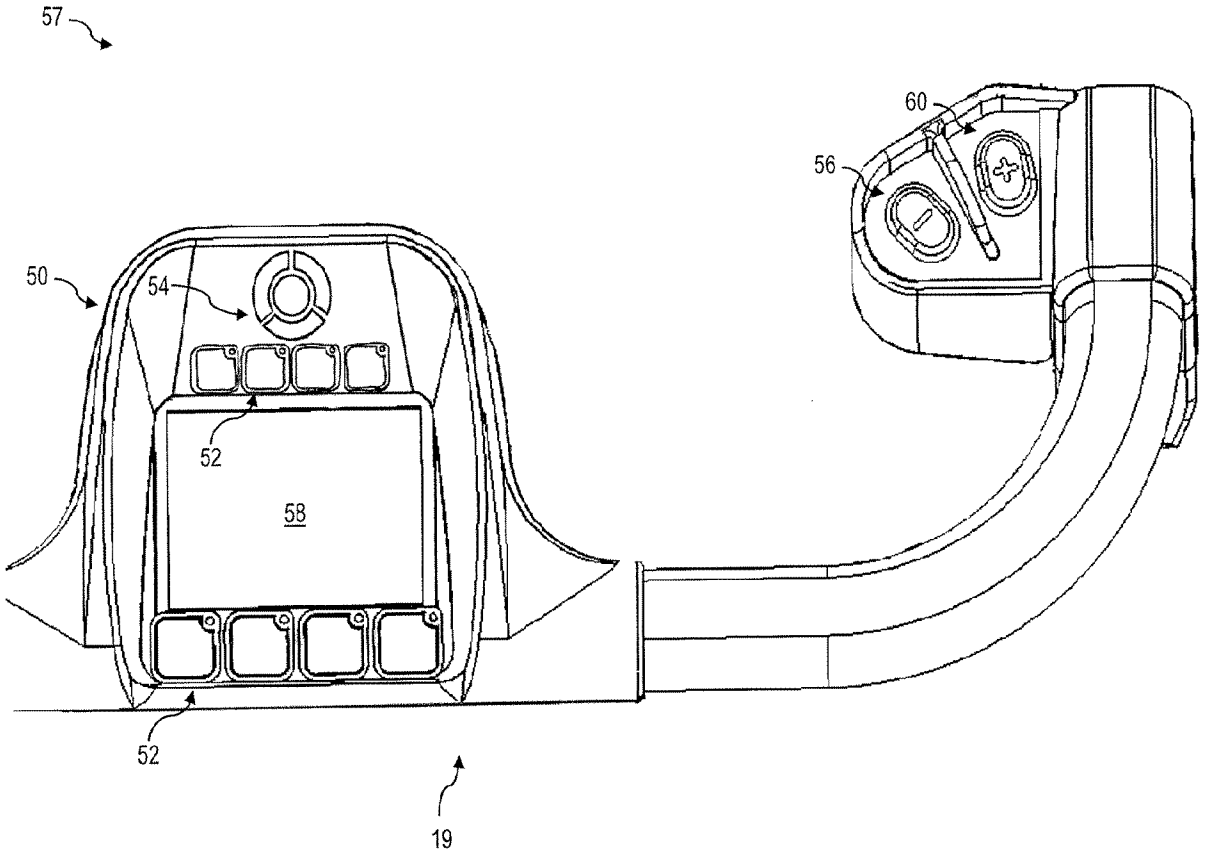
FIG. 8 schematically depicts a front end of a cot according to one or more embodiments described herein.

Referring collectively to FIGS. 2, 7 and 8, the operator controls 57 can be operable to receive user input indicative of a desire to perform a cot function. The operator controls 57 can be communicatively coupled to the one or more processors 100 such that input received by the operator controls 57 can be transformed into control signals that are received by the one or more processors 100. Accordingly, the operator controls 57 can comprise any type of tactile input capable of transforming a physical input into a control signal such as, for example, a button, a switch, a microphone, a knob, or the like. It is noted that, while the embodiments described herein make reference to automated operation of the front actuator 16 and back actuator 18, the embodiments described herein can include operator controls 57 that are configured to directly control front actuator 16 and back actuator 18. That is, the automated processes described herein can be overridden by a user and the front actuator 16 and back actuator 18 can be actuated independent of input from the controls. In other words, e.g., the cot control system or control box 50 is operably connected to the cot actuation system 34 to control raising and lowering of the pair of front legs 20 via front actuator 16 and the pair of back legs 40, independently, and which detects a presence of a signal e.g., a control signal from operator controls 57, requesting a change in elevation of the support frame 12 to cause the cot actuation system 34 to move either or both pairs of the front and back wheels 26, 46 relative to the support frame 12 via the raising or the lowering of the pair of front legs 20 and/or the pair of back legs 40.

In some embodiments, the operator controls 57 can be located on the back end 19 of the roll-in cot 10. For example, the operator controls 57 can comprise a button array 52 located adjacent to and beneath the visual display component or GUI 58. The button array 52 can comprise a plurality of buttons arranged in a linear row. Each button of the button array 52 can comprise an optical element (i.e., an LED) that can emit visible wavelengths of optical energy when the button is activated. Alternatively or additionally, the operator controls 57 can comprise a button array 52 located adjacent to and above the visual display component or GUI 58. It is noted that, while each button array 52 is depicted as consisting of four buttons, the button array 52 can comprise any number of buttons. Moreover, the operator controls 57 can comprise a concentric button array 54 comprising a plurality of arc shaped buttons arranged concentrically around a central button. In some embodiments, the concentric button array 54 can be located above the visual display component or GUI 58. In still other embodiments, one or more buttons 53, which can provide the same and/or additional functions to any of the buttons in the button array 52 and/or 54 may be provided on either or both the sides of control box 50. It is noted that, while the operator controls 57 are depicted as being located at the back end 19 of the roll-in cot 10, it is further contemplated that the operator controls 57 can be positioned at alternative positions on the support frame 12, for example, on the front end 17 or the sides of the support frame 12. In still further embodiments, the operator controls 57 may be located in a removably attachable wireless remote control that may control the roll-in cot 10 without physical attachment to the roll-in cot 10.

The operator controls 57 can further include a lower button 56 (–) operable to receive input indicative of a desire to lower (–) the roll-in cot 10 and a raise button 60 (+) operable to receive input indicative of a desire to raise (+) the roll-in cot 10. It is to be appreciated that in other embodiments the raising and/or lowering commanding function can be assigned to other buttons, such as ones of the button arrays 52 and/or 54, in addition to buttons 56, 60. As is explained in greater detail herein, each of the lower button 56 (–) and the raise button 60 (+) can generate signals that actuate, via the actuation system 34, the front legs 20, the back legs 40, or both in order to perform cot functions. The cot functions may require the front legs 20, the back legs 40, or both to be raised, lowered, retracted or released depending on the position and orientation of the roll-in cot 10. In some embodiments, each of the lower button 56 (–) and the raise button 60 (+) can be analog (i.e., the pressure and/or displacement of the button can be proportional to a parameter of the control signal). Accordingly, the speed of actuation of the front legs 20, the back legs 40, or both can be proportional to the parameter of the control signal. Alternatively or additionally, each of the lower button 56 (–) and the raise button 60 (+) can be backlit.

Turning now to embodiments of the roll-in cot 10 being simultaneously actuated, the roll-in cot 10 of FIG. 2 is depicted as extended, thus front actuator sensor 62 and back actuator sensor 64 detect that the front actuator 16 and the back actuator 18 are at a first position, i.e., the front and back actuators 16, 18 are in contact and/or close proximate to their respective cross member 63, 65 such as when the loading end legs 20 and the back legs 40 are in contact with a lower surface and are loaded. The front and back actuators 16 and 18 are both active when the front and back actuator sensors 62, 64 detect both the front and back actuators 16, 18, respectively, are at the first position and can be lowered or raised by the operator using the lower button 56 (–) and the raise button 60 (+).

Figure 4A:
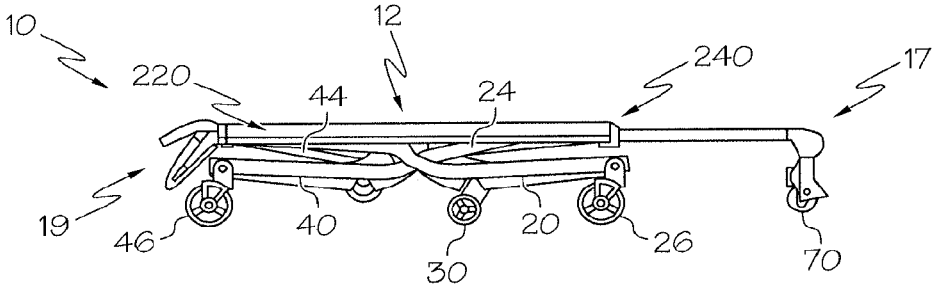
FIGS. 4A-4C is a side view depicting a raising and/or lowering sequence of a cot according to one or more embodiments described herein.
Figure 4B:
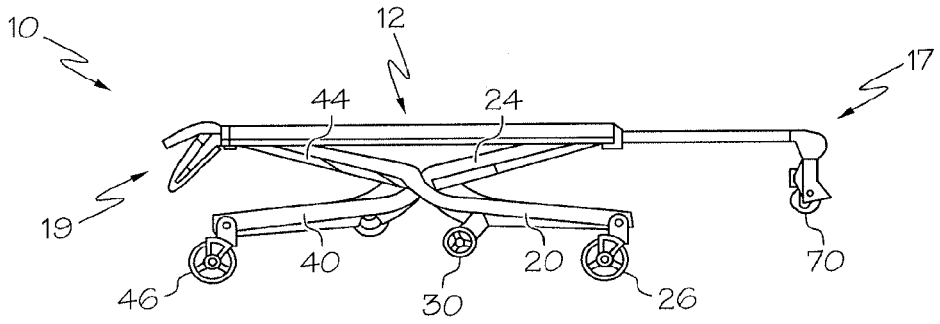
Figure 4C:
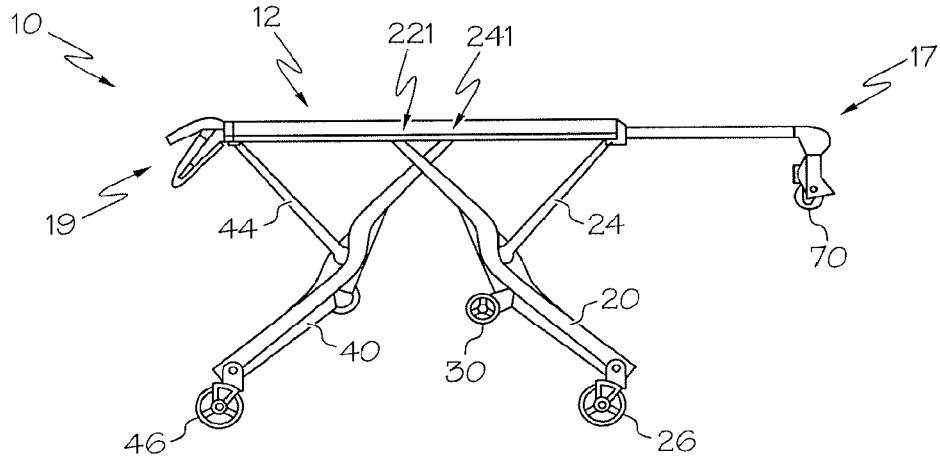
Figure 5D:
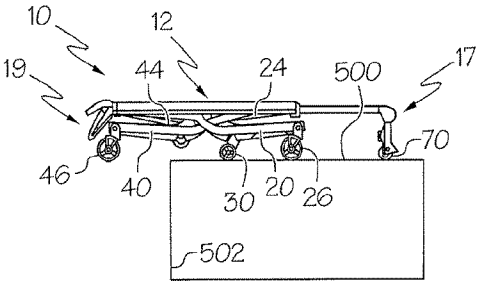
FIGS. 5A-5E is a side view depicting a loading and/or unloading sequence of a cot according to one or more embodiments described herein.
Figure 5E:
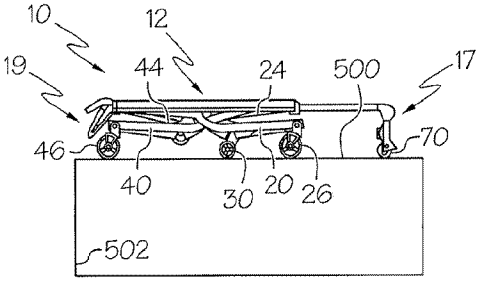

Referring collectively to FIGS. 4A-4C, an embodiment of the roll-in cot 10 being raised (FIGS. 4A-4C) or lowered (FIGS. 4C-4A) via simultaneous actuation is schematically depicted (note that for clarity the front actuator 16 and the back actuator 18 are not depicted in FIGS. 4A-4C). In the depicted embodiment, the roll-in cot 10 comprises a support frame 12 slidingly engaged with a pair of front legs 20 and a pair of back legs 40. Each of the front legs 20 are rotatably coupled to a front hinge member 24 that is rotatably coupled to the support frame 12. Each of the back legs 40 are rotatably coupled to a back hinge member 44 that is rotatably coupled to the support frame 12. In the depicted embodiment, the front hinge members 24 are rotatably coupled towards the front end 17 of the support frame 12 and the back hinge members 44 that are rotatably coupled to the support frame 12 towards the back end 19.

FIG. 4A depicts the roll-in cot 10 in a lowest transport position. Specifically, the back wheels 46 and the front wheels 26 are in contact with a surface, the front leg 20 is slidingly engaged with the support frame 12 such that the front leg 20 contacts a portion of the support frame 12 towards the back end 19 and the back leg 40 is slidingly engaged with the support frame 12 such that the back leg 40 contacts a portion of the support frame 12 towards the front end 17. FIG. 4B depicts the roll-in cot 10 in an intermediate transport position, i.e., the front legs 20 and the back legs 40 are in intermediate transport positions along the support frame 12. FIG. 4C depicts the roll-in cot 10 in a highest transport position, i.e., the front legs 20 and the back legs 40 positioned along the support frame 12 such that the front load wheels 70 are at a maximum desired height which can be set to height sufficient to load the cot, as is described in greater detail herein.

The embodiments described herein may be utilized to lift a patient from a position below a vehicle in preparation for loading a patient into the vehicle (e.g., from the ground to above a loading surface of an ambulance). Specifically, the roll-in cot 10 may be raised from the lowest transport position (FIG. 4A) to an intermediate transport position (FIG. 4B) or the highest transport position (FIG. 4C) by simultaneously actuating the front legs 20 and back legs 40 and causing them to slide along the support frame 12. When being raised, the actuation causes the front legs to slide towards the front end 17 and to rotate about the front hinge members 24, and the back legs 40 to slide towards the back end 19 and to rotate about the back hinge members 44.

Specifically, a user may interact with the operator controls 57 (FIG. 8) and provide input indicative of a desire to raise the roll-in cot 10 (e.g., by pressing the raise button 60 (+)). The roll-in cot 10 is raised from its current position (e.g., lowest transport position or an intermediate transport position) until it reaches the highest transport position. Upon reaching the highest transport position, the actuation may cease automatically, i.e., to raise the roll-in cot 10 higher additional input is required. Input may be provided to the roll-in cot 10 and/or operator controls 57 in any manner such as electronically, audibly or manually.

The roll-in cot 10 may be lowered from an intermediate transport position (FIG. 4B) or the highest transport position (FIG. 4C) to the lowest transport position (FIG. 4A) by simultaneously actuating the front legs 20 and back legs 40 and causing them to slide along the support frame 12. Specifically, when being lowered, the actuation causes the front legs to slide towards the back end 19 and to rotate about the front hinge members 24, and the back legs 40 to slide towards the front end 17 and to rotate about the back hinge members 44. For example, a user may provide input indicative of a desire to lower the roll-in cot 10 (e.g., by pressing the lower button 56 (−)). Upon receiving the input, the roll-in cot 10 lowers from its current position (e.g., highest transport position or an intermediate transport position) until it reaches the lowest transport position. Once the roll-in cot 10 reaches its lowest height (e.g., the lowest transport position) the actuation may cease automatically. In some embodiments, the control box 50 provides a visual indication that the front legs 20 and back legs 40 are active during movement.

In one embodiment, when the roll-in cot 10 is in the highest transport position (FIG. 4C), the front legs 20 are in contact with the support frame 12 at a front-loading index 221 and the back legs 40 are in contact with the support frame 12 at a back-loading index 241. While the front-loading index 221 and the back-loading index 241 are depicted in FIG. 4C as being located near the middle of the support frame 12, additional embodiments are contemplated with the front-loading index 221 and the back-loading index 241 located at any position along the support frame 12. Some embodiments can have a load position that is higher than the highest transport position. For example, the highest load position may be set by actuating the roll-in cot 10 to the desired height and providing input indicative of a desire to set the highest load position.

When the roll-in cot 10 is in the lowest transport position (FIG. 4A), the front legs 20 may be in contact with the support frame 12 at a front-flat index 220 located near the back end 19 of the support frame 12 and the back legs 40 may be in contact with the support frame 12 a back-flat index 240 located near the front end 17 of the support frame 12. Furthermore, it is noted that the term "index," as used herein means a position along the support frame 12 that corresponds to a mechanical stop or an electrical stop such as, for example, an obstruction in a channel formed in a lateral side member 15, a locking mechanism, or a stop controlled by a servomechanism.

The front actuator 16 is operable to raise or lower a front end 17 of the support frame 12 independently of the back actuator 18. The back actuator 18 is operable to raise or lower a back end 19 of the support frame 12 independently of the front actuator 16. By raising the front end 17 or back end 19 independently, the roll-in cot 10 is able to maintain the support frame 12 level or substantially level when the roll-in cot 10 is moved over uneven surfaces, for example, a staircase or hill. Specifically, if one of the front actuator 16 or the back actuator 18 is in a second position relative to a first position, the set of legs not in contact with a surface (i.e., the set of legs that is in tension, such as when the cot is being lifted at one or both ends) is activated by the roll-in cot 10 (e.g., moving the roll-in cot 10 off of a curb).

Referring collectively to FIGS. 4C-5E, independent actuation may be utilized by the embodiments described herein for loading a patient into a vehicle (note that for clarity the front actuator 16 and the back actuator 18 are not depicted in FIGS. 4C-5E). Specifically, the roll-in cot 10 can be loaded onto a loading surface 500 according the process described below. First, the roll-in cot 10 may be placed into the highest load position or any position where the front load wheels 70 are located at a height greater than the loading surface 500. When the roll-in cot 10 is loaded onto a loading surface 500, the roll-in cot 10 may be raised via front and back actuators 16 and 18 to ensure the front load wheels 70 are disposed over a loading surface 500. In some embodiments, the front actuator 16 and the back actuator 18 can be actuated contemporaneously to keep the roll-in cot level until the height of the roll-in cot is at a predetermined position. Once the predetermined height is reached, the front actuator 16 can raise the front end 17 such that the roll-in cot 10 is angled at its highest load position. Accordingly, the roll-in cot 10 can be loaded with the back end 19 lower than the front end 17. Then, the roll-in cot 10 may be lowered until front load wheels 70 contact the loading surface 500 (FIG. 5A).

Figure 5C:
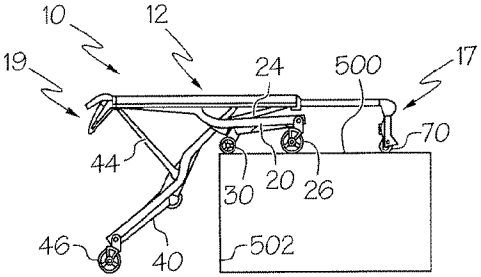
Figure 5A:
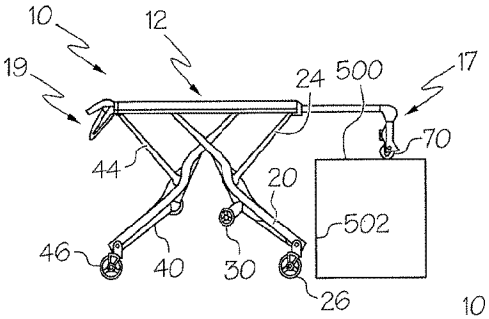
Figure 5B:
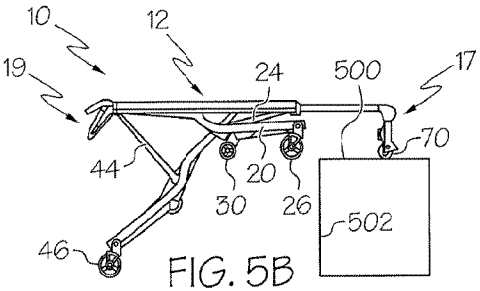

As is depicted in FIG. 5A, the front load wheels 70 are over the loading surface 500. In one embodiment, after the load wheels contact the loading surface 500 the pair of front legs 20 can be actuated with the front actuator 16 because the front end 17 is above the loading surface 500. As depicted in FIGS. 5A and 5B, the middle portion of the roll-in cot 10 is away from the loading surface 500 (i.e., a large enough portion of the roll-in cot 10 has not been loaded beyond the loading edge 502 such that most of the weight of the roll-in cot 10 can be cantilevered and supported by the wheels 70, 26, and/or 30). When the front load wheels 70 are sufficiently loaded, the roll-in cot 10 may be held level with a reduced amount of force. Additionally, in such a position, the front actuator 16 is in a second position relative to a first position and the back actuator 18 is in a first position relative to a second position. Thus, for example, if the lower button 56 (−) is activated, the front legs 20 are raised (FIG. 5B).

In one embodiment, after the front legs 20 have been raised enough to trigger a loading state, the operation of the front actuator 16 and the back actuator 18 is dependent upon the location of the roll-in cot 10. In some embodiments, upon the front legs 20 raising, a visual indication is provided on the visual display component or GUI 58 of the control box 50 (FIG. 2). The visual indication may be color-coded (e.g., activated legs in green and non-activated legs in red). The front actuator 16 may automatically cease to operate when the front legs 20 have been fully retracted. Furthermore, it is noted that during the retraction of the front legs 20, the front actuator sensor 62 may detect a second position relative to a first position, at which point, front actuator 16 may raise the front legs 20 at a higher rate; for example, fully retract within about 2 seconds.

Referring collectively to FIGS. 3, 5B, and 7, the back actuator 18 can be automatically actuated by the one or more processors 100 after the front load wheels 70 have been loaded upon the loading surface 500 to assist in the loading of the roll-in cot 10 onto the loading surface 500. Specifically, when the front angular sensor 66 detects that the front angle $\alpha_f$ is less than a predetermined angle, the one or more processors 100 can automatically actuate the back actuator 18 to extend the back legs 40 and raise the back end 19 of the roll-in cot 10 higher than the original loading height. The predetermined angle can be any angle indicative of a loading state or a percentage of extension such as, for example, less than about 10% extension of the front legs 20 in one embodiment, or less than about 5% extension of the front legs 20 in another embodiment. In some embodiments, the one or more processors 100 can determine if the load end sensor 76 indicates that the front load wheels 70 are touching the loading surface 500 prior to automatically actuating the back actuator 18 to extend the back legs 40.

In further embodiments, the one or more processors 100 can monitor the back angular sensor 68 to verify that the back angle $\alpha_b$ is changing in accordance to the actuation of the back actuator 18. In order to protect the back actuator 18, the one or more processors 100 can automatically abort the actuation of the back actuator 18 if the back angle $\alpha_b$ is indicative of improper operation. For example, if the back angle $\alpha_b$ fails to change for a predetermined amount of time (e.g., about 200 ms), the one or more processors 100 can automatically abort the actuation of the back actuator 18.

Referring collectively to FIGS. 5A-5E, after the front legs 20 have been retracted, the roll-in cot 10 may be urged forward until the intermediate load wheels 30 have been loaded onto the loading surface 500 (FIG. 5C). As depicted in FIG. 5C, the front end 17 and the middle portion of the roll-in cot 10 are above the loading surface 500. As a result, the pair of back legs 40 can be retracted with the back actuator 18. Specifically, the intermediate load sensor 77 can detect when the middle portion is above the loading surface 500. When the middle portion is above the loading surface 500 during a loading state (e.g., the front legs 20 and back legs 40 have an angle delta greater than the loading state angle), the back actuator may be actuated. In one embodiment, an indication may be provided by the control box 50 (FIG. 2) when the intermediate load wheels 30 are sufficiently beyond the loading edge 502 to allow for back leg 40 actuation (e.g., an audible beep may be provided).

It is noted that, the middle portion of the roll-in cot 10 is above the loading surface 500 when any portion of the roll-in cot 10 that may act as a fulcrum is sufficiently beyond the loading edge 502 such that the back legs 40 may be retracted with a reduced amount of force is required to lift the back end 19 (e.g., less than half of the weight of the roll-in cot 10, which may be loaded, needs to be supported at the back end 19). Furthermore, it is noted that the detection of the location of the roll-in cot 10 may be accomplished by sensors located on the roll-in cot 10 and/or sensors on or adjacent to the loading surface 500. For example, an ambulance may have sensors that detect the positioning of the roll-in cot 10 with respect to the loading surface 500 and/or loading edge 502 and communications means to transmit the information to the roll-in cot 10.

Referring to FIG. 5D, after the back legs 40 are retracted and the roll-in cot 10 may be urged forward. In one embodiment, during the back leg retraction, the back actuator sensor 64 may detect that the back legs 40 are unloaded, at which point, the back actuator 18 may raise the back legs 40 at higher speed. Upon the back legs 40 being fully retracted, the back actuator 18 may automatically cease to operate. In one embodiment, an indication may be provided by the control box 50 (FIG. 2) when the roll-in cot 10 is sufficiently beyond the loading edge 502 (e.g., fully loaded or loaded such that the back actuator is beyond the loading edge 502).

Once the cot is loaded onto the loading surface (FIG. 5E), the front and back actuators 16, 18 may be deactivated by being lockingly coupled to an ambulance. The ambulance and the roll-in cot 10 may each be fitted with components suitable for coupling, for example, male-female connectors. Additionally, the roll-in cot 10 may comprise a sensor which registers when the cot is fully disposed in the ambulance, and sends a signal which results in the locking of the actuators 16, 18. In yet another embodiment, the roll-in cot 10 may be connected to a cot fastener, which locks the actuators 16, 18, and is further coupled to the ambulance's power system, which charges the roll-in cot 10. A commercial example of such ambulance charging systems is the Integrated Charging System (ICS) produced by Ferno-Washington, Inc.

Referring collectively to FIGS. 5A-5E, independent actuation, as is described above, may be utilized by the embodiments described herein for unloading the roll-in cot 10 from a loading surface 500. Specifically, the roll-in cot 10 may be unlocked from the fastener and urged towards the loading edge 502 (FIG. 5E to FIG. 5D). As the back wheels 46 are released from the loading surface 500 (FIG. 5D), the back actuator sensor 64 detects that the back legs 40 are unloaded and allows the back legs 40 to be lowered. In some embodiments, the back legs 40 may be prevented from lowering, for example if sensors detect that the cot is not in the correct location (e.g., the back wheels 46 are above the loading surface 500 or the intermediate load wheels 30 are away from the loading edge 502). In one embodiment, an indication may be provided by the control box 50 (FIG. 2) when the back actuator 18 is activated (e.g., the intermediate load wheels 30 are near the loading edge 502 and/or the back actuator sensor 64 detects a second position relative to a first position).

Referring collectively to FIGS. 5D and 7, the line indicator 74 can be automatically actuated by the one or more processors to project a line upon the loading surface 500 indicative of the center of balance of the roll-in cot 10. In one embodiment, the one or more processors 100 can receive input from the intermediate load sensor 77 indicative of the intermediate load wheels 30 being in contact with the loading surface. The one or more processors 100 can also receive input from the back actuator sensor 64 indicative of back actuator 18 being in a second position relative to a first position. When the intermediate load wheels 30 are in contact with the loading surface and the back actuator 18 is in a second position relative to a first position, the one or more processors can automatically cause the line indicator 74 to project the line. Accordingly, when the line is projected, an operator can be provided with a visual indication on the load surface that can be utilized as a reference for loading, unloading, or both. Specifically, the operator can slow the removal of the roll-in cot 10 from the loading surface 500 as the line approaches the loading edge 502, which can allow additional time for the back legs 40 to be lowered. Such operation can minimize the amount of time that the operator will be required to support the weight of the roll-in cot 10.

Referring collectively to FIGS. 5A-5E, when the roll-in cot 10 is properly positioned with respect to the loading edge 502, the back legs 40 can be extended (FIG. 5C). For example, the back legs 40 may be extended by pressing the raise button 60 (+). In one embodiment, upon the back legs 40 lowering, a visual indication is provided on the visual display component or GUI 58 of the control box 50 (FIG. 2). For example, a visual indication may be provided when the roll-in cot 10 is in a loading state and the back legs 40 and/or front legs 20 are actuated. Such a visual indication may signal that the roll-in cot should not be moved (e.g., pulled, pushed, or rolled) during the actuation. When the back legs 40 contact the floor (FIG. 5C), the back legs 40 become loaded and the back actuator sensor 64 deactivates the back actuator 18.

When a sensor detects that the front legs 20 are clear of the loading surface 500 (FIG. 5B), the front actuator 16 is activated. In one embodiment, when the intermediate load wheels 30 are at the loading edge 502 an indication may be provided by the control box 50 (FIG. 2). The front legs 20 are extended until the front legs 20 contact the floor (FIG. 5A). For example, the front legs 20 may be extended by pressing the raise button 60 (+). In one embodiment, upon the front legs 20 lowering, a visual indication is provided on the visual display component or GUI 58 of the control box 50 (FIG. 2).

Referring collectively to FIGS. 7 and 8, actuation of any of the operator controls 57 can cause a control signal to be received by the one or more processors 100. The control signal can be encoded to indicate that one or more of the operator controls has been actuated. The encoded control signals can be associated with a pre-programmed cot function. Upon receipt of the encoded control signal, the one or more processors 100 can execute a cot function automatically. In some embodiments, the cot functions can comprise an open door function that transmits an open door signal to a vehicle. Specifically, the roll-in cot 10 can comprise a communication circuit 82 communicatively coupled to the one or more processors 100. The communication circuit 82 can be configured to exchange communication signals with a vehicle such as, for example, an ambulance or the like. The communication circuit 82 can comprise a wireless communication device such as, but not limited to, personal area network transceiver, local area network transceiver, radio frequency identification (RFID), infrared transmitter, cellular transceiver, or the like.

The control signal of one or more of the operator controls 57 can be associated with the open door function. Upon receipt of the control signal associated with the open door function, the one or more processors 100 can cause the communication circuit 82 to transmit an open door signal to a vehicle within range of the open door signal. Upon receipt of the open door signal, the vehicle can open a door for receiving the roll-in cot 10. Additionally, the open door signal can be encoded to identify the roll-in cot 10 such as, for example, via classification, unique identifier or the like. In further embodiments, the control signal of one or more of the operator controls 57 can be associated with a close door function that operates analogously to the open door function and causes the door of the vehicle to close.

Referring collectively to FIGS. 3, 7, and 8, the cot functions can comprise an automatic leveling function that automatically levels the front end 17 and the back end 19 of the roll-in cot 10 with respect to gravity. Accordingly, the front angle $\alpha_f$, the back angle $\alpha_b$, or both can be automatically adjusted to compensate for uneven terrain. For example, if back end 19 is lower than the front end 17 with respect to gravity, the back end 19 can be raised automatically to level the roll-in cot 10 with respect to gravity, the front end 17 can be lowered automatically to level the roll-in cot 10 with respect to gravity, or both. Conversely, if back end 19 is higher than the front end 17 with respect to gravity, the back end 19 can be lowered automatically to level the roll-in cot 10 with respect to gravity, the front end 17 can be raised automatically to level the roll-in cot 10 with respect to gravity, or both.

Referring collectively to FIGS. 2 and 7, the roll-in cot 10 can comprise a gravitational reference sensor 80 configured to provide a gravitational reference signal indicative of an earth frame of reference. The gravitational reference sensor 80 can comprise an accelerometer, a gyroscope, an inclinometer, or the like. The gravitational reference sensor 80 can be communicatively coupled to the one or more processors 100, and coupled to the roll-in cot 10 at a position suitable for detecting the level of the roll-in cot 10 with respect to gravity, such as, for example, the support frame 12.

The control signal of one or more of the operator controls 57 can be associated with the automatic leveling function. Specifically, any of the operator controls 57 can transmit a control signal associated with enabling or disabling the automatic leveling function. Alternatively or additionally, other cot functions can selectively enable or disable the cot leveling function. When the automatic leveling function is enabled, the gravitational reference signal can be received by the one or more processors 100. The one or more processors 100 can automatically compare the gravitational reference signal to an earth reference frame indicative of earth level. Based upon the comparison, the one or more processors 100 can automatically quantify the difference between the earth reference frame and the current level of the roll-in cot 10 indicated by the gravitational reference signal. The difference can be transformed into a desired adjustment amount to level the front end 17 and the back end 19 of the roll-in cot 10 with respect to gravity. For example, the difference can be transformed into angular adjustment to the front angle $\alpha_f$, the back angle $\alpha_b$, or both. Thus, the one or more processors 100 can automatically actuate the actuators 16, 18 until the desired amount of adjustment has been achieved, i.e., the front angular sensor 66, the back angular sensor 68, and the gravitational reference sensor 80 can be used for feedback.

Figure 9:
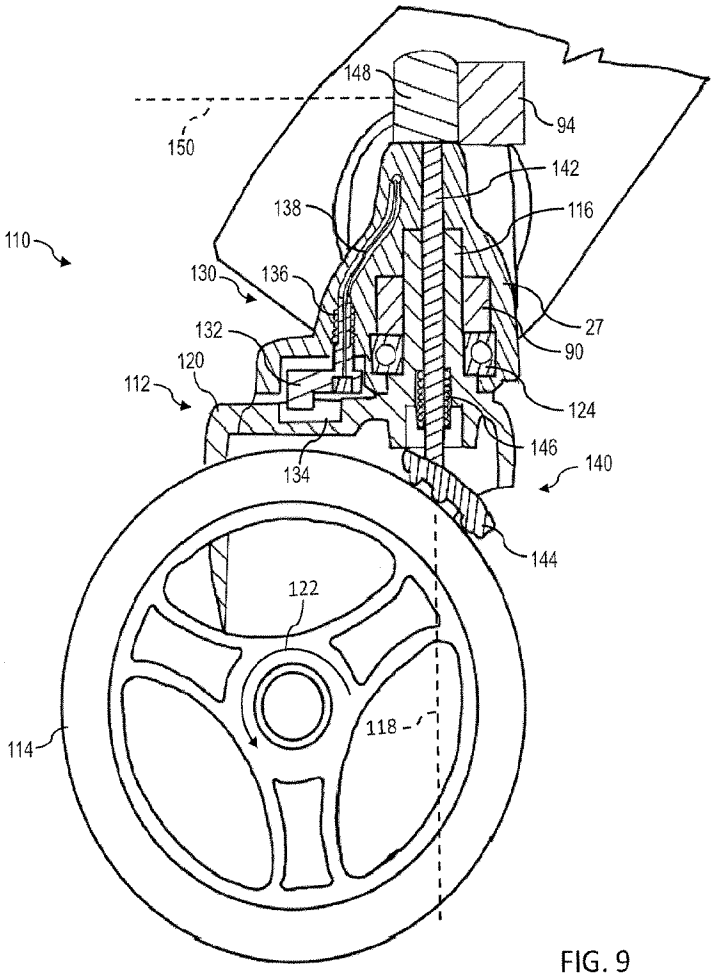
FIG. 9 schematically depicts a wheel assembly according to one or more embodiments described herein.
Figure 10:
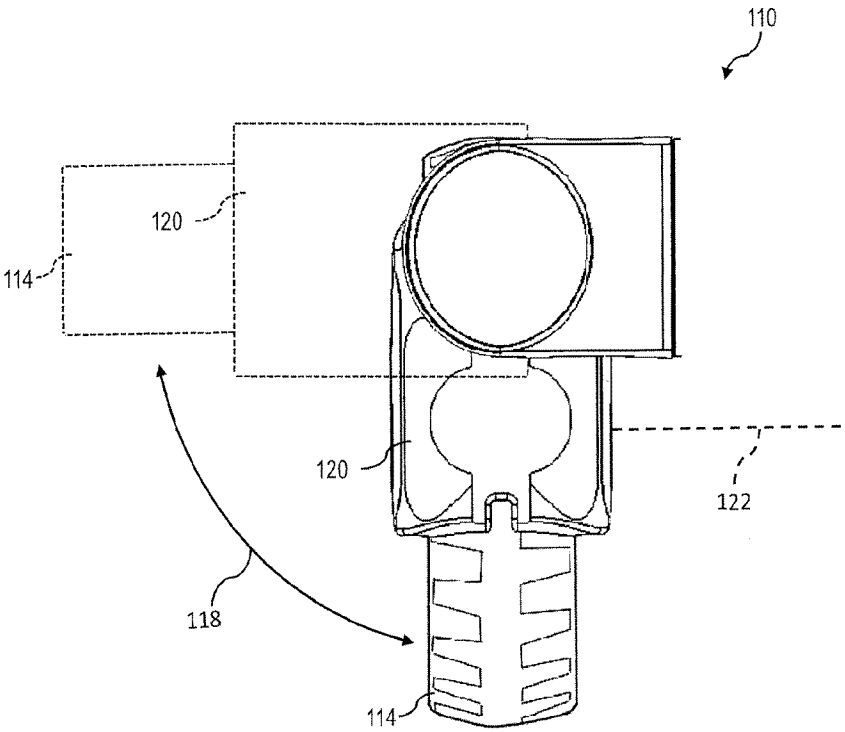
FIG. 10 schematically depicts a wheel assembly according to one or more embodiments described herein.

Referring collectively to FIGS. 1, 9 and 10, one or more of the front wheels 26 and back wheels 46 can comprise a wheel assembly 110 for automatic actuation. Accordingly, while the wheel assembly 110 is depicted in FIG. 9 as being coupled to the linkage 27, the wheel assembly can be coupled to a linkage 47. The wheel assembly 110 can comprise a wheel steering module 112 for directing the orientation of a wheel 114 with respect to the roll-in cot 10. The wheel steering module 112 can comprise a control shaft 116 that defines a rotational axis 118 for steering, a turning mechanism 90 for actuating the control shaft 116, and a fork 120 that defines a rotational axis 122 for the wheel 114. In some embodiments, the control shaft 116 can be rotatably coupled to the linkage 27 such that the control shaft 116 rotates around the rotational axis 118. The rotational motion can be facilitated by a bearing 124 located between the control shaft 116 can the linkage 27.

The turning mechanism 90 can be operably coupled to the control shaft 116 and can be configured to propel the control shaft 116 around the rotational axis 118. The turning mechanism 90 can comprise a servomotor and an encoder. Accordingly, the turning mechanism 90 can directly actuate the control shaft 116. In some embodiments, the turning mechanism 90 can be configured to turn freely to allow the control shaft 116 to swivel around the rotational axis 118 as the roll-in cot 10 is urged into motion. Optionally, the turning mechanism 90 can be configured to lock in place and resist motion of the control shaft 116 around the rotational axis 118.

Referring collectively to FIGS. 7 and 9-10, the wheel assembly 110 can comprise a swivel locking module 130 for locking the fork 120 in a substantially fixed orientation. The swivel locking module 130 can comprise a bolt member 132 for engagement with a catch member 134, a bias member 136 that biases the bolt member 132 away from the catch member 134, and a cable 138 for transmitting mechanical energy between a lock actuator 92 and the bolt member 132. The lock actuator 92 can comprise a servomotor and an encoder.

The bolt member 132 can be received with a channel formed through the linkage 27. The bolt member 132 can travel into the channel such that the bolt member 132 is free of the catch member 134 and out of the channel into an interference position within the catch member 134. The bias member 136 can bias the bolt member 132 towards the interference position. The cable 138 can be coupled to the bolt member 132 and operably engaged with the lock actuator 92 such that the lock actuator 92 can transmit a force sufficient to overcome the bias member 136 and translate the bolt member 132 from the interference position to free the bolt member 132 of the catch member 134.

In some embodiments, the catch member 134 can be formed in or coupled to the fork 120. The catch member 134 can comprise a rigid body that forms an orifice that is complimentary to the bolt member 132. Accordingly, the bolt member 132 can travel in and out of the catch member via the orifice. The rigid body can be configured to interfere with motion of the catch member 134 that is caused by motion of the control shaft 116 around the rotational axis 118. Specifically, when in the inference position, the bolt member 132 can be constrained by the rigid body of the catch member 134 such that motion of the control shaft 116 around the rotational axis 118 is substantially mitigated.

Referring collectively to FIGS. 7 and 9-10, the wheel assembly 110 can comprise a braking module 140 for resisting rotation of the wheel 114 around the rotational axis 122. The braking module 140 can comprise a brake piston 142 for transmitting braking force to a brake pad 144, a bias member 146 that biases the brake piston 142 away from the wheel 114, and a brake mechanism 94 that provides braking force to the brake piston 142. In some embodiments, the brake mechanism 94 can comprise a servomotor and an encoder. The brake mechanism 94 can be operably coupled to a brake cam 148 such that actuation of the brake mechanism 94 causes the brake cam 148 to rotate around a rotational axis 150. The brake piston 142 can act as a cam follower. Accordingly, rotational motion of the brake cam 148 can be converted to linear motion of the brake piston 142 that moves the brake piston 142 towards and away from the wheel 114 depending upon the direction of rotation of the brake cam 148.

The brake pad 144 can be coupled to the brake piston 142 such that motion of the brake piston 142 towards and away from the wheel 114 causes the brake pad 144 to engage and disengage from the wheel 114. In some embodiments, the brake pad 144 can be contoured to match the shape of the portion of the wheel 114 that the brake pad 144 contacts during braking. Optionally, the contact surface of the brake pad 144 can comprise protrusions and grooves.

Referring again to FIG. 7, each of the turning mechanism 90, the lock actuator 92, and the brake mechanism 94 can be communicatively coupled to the one or more processors 100. Accordingly, any of the operator controls 57 can be encoded to provide control signals that are operable to cause any of the operations of the turning mechanism 90, the lock actuator 92, the brake mechanism 94, or combinations thereof to be performed automatically. Alternatively or additionally, any cot function can cause the any of the operations of the turning mechanism 90, the lock actuator 92, the brake mechanism 94, or combinations thereof to be performed automatically.

Referring collectively to FIGS. 3 and 7-10, any of the operator controls 57 can be encoded to provide control signals that are operable to cause the turning mechanism 90 to actuate the fork 120 into an outboard position (depicted in FIG. 10 as dashed lines). Alternatively or additionally, the cot functions (e.g., a chair function) can be configured to selectively cause the turning mechanism 90 to actuate the fork 120 into the outboard position. When arranged in the outboard position, the fork 120 and the wheel 114 can be oriented orthogonally with respect to the length of the roll-in cot 10 (direction from the front end 17 to back end 19). Accordingly, the front wheels 26, the back wheels 46, or both can be arranged in the outboard position such that the front wheels 26, the back wheels 46, or both are directed towards the support frame 12.

Figure 11:
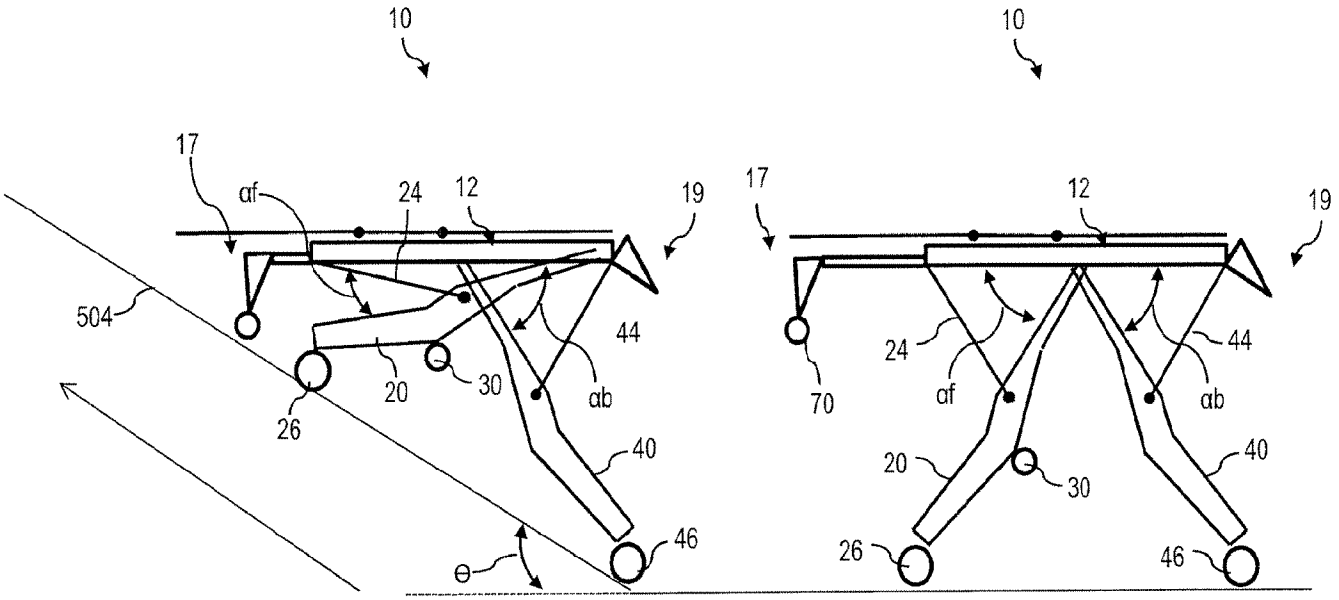
FIG. 11 schematically depicts an up escalator function according to one or more embodiments described herein.
Figure 12:
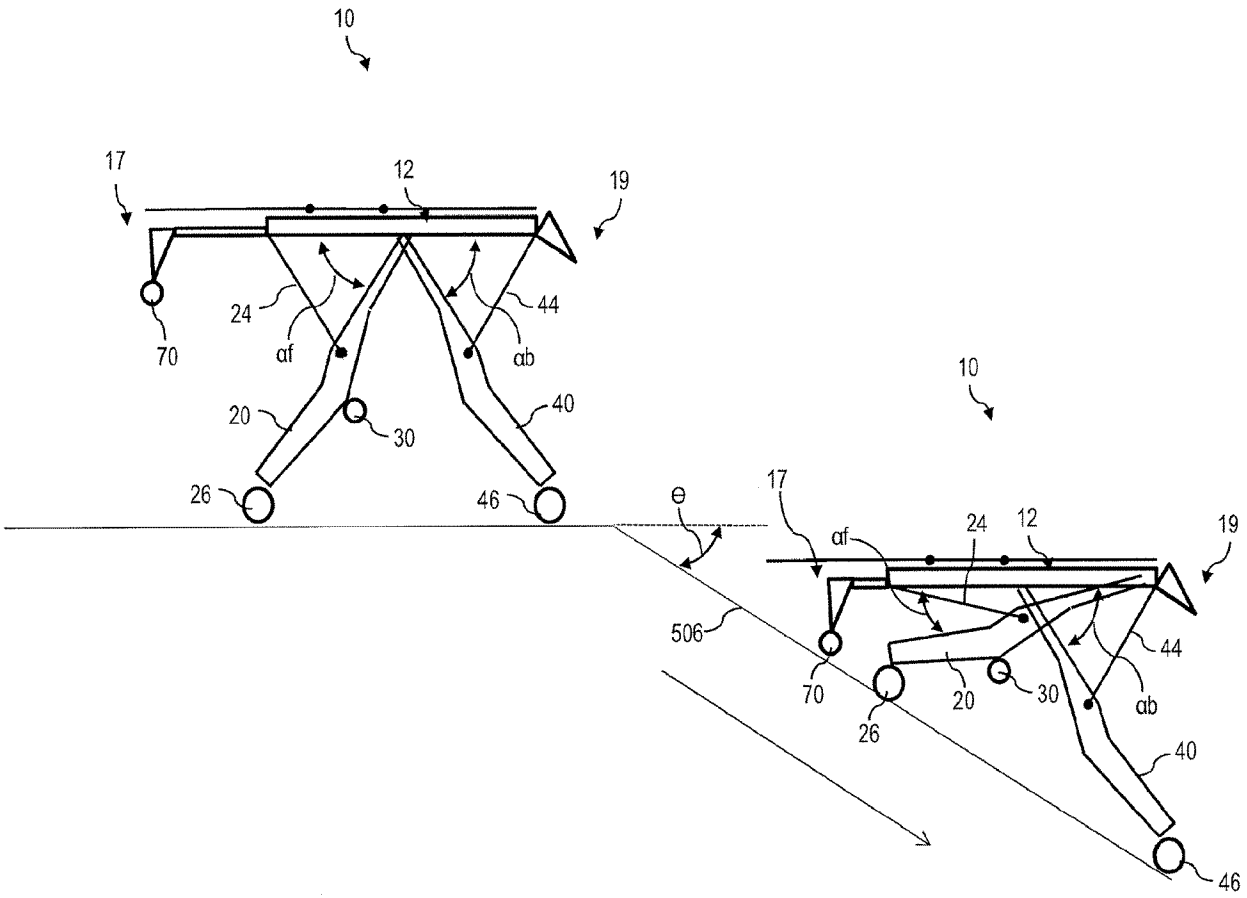
FIG. 12 schematically depicts a down escalator function according to one or more embodiments described herein.

Referring collectively to FIGS. 8, and 11-12, the cot functions can include an escalator function configured to maintain a patient supported by a patient support 14 level while the roll-in cot 10 is supported by an escalator. Accordingly, any of the operator controls 57 can be encoded to provide control signals that are operable to cause the escalator function to be activated, deactivated, or both. In some embodiments, the escalator function can be configured to orient the roll-in cot 10 such that a patient is facing in the same direction with respect to the slope of the escalator, while riding an up escalator 504 or a down escalator 506. Specifically, the escalator function can ensure that the back end 19 of the roll-in cot 10 facing a downward slope of the up escalator 504 and the down escalator 506. In other words, the roll-in cot 10 can be configured such that the back end 19 of the roll-in cot is loaded last upon the up escalator 504 or the down escalator 506.

Figure 13:
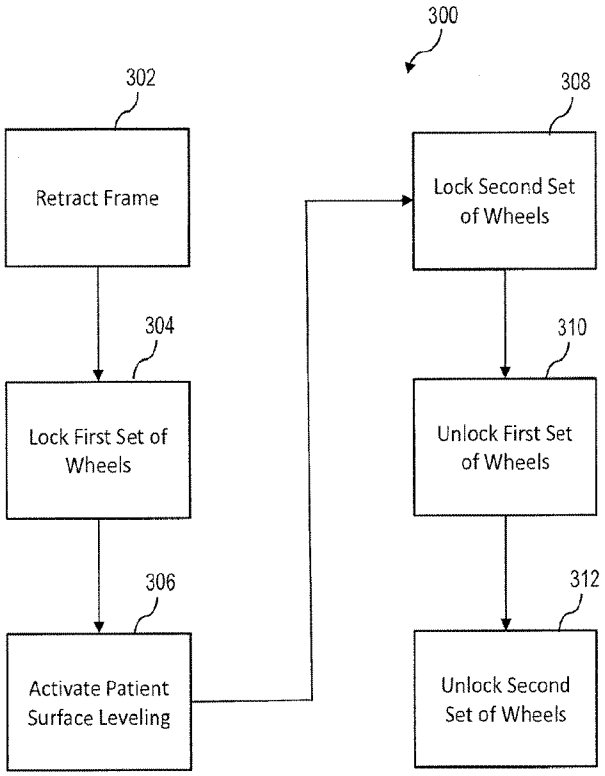
FIG. 13 schematically depicts method for performing an escalator function according to one or more embodiments described herein.

Referring now to FIG. 13, the escalator function can be implemented according to a method 300. It is noted that, while the method 300 is depicted in FIG. 13 as comprising a plurality of enumerated processes, any of the processes of the method 300 can be performed in any order or omitted without departing from the scope of the present disclosure. At process 302, the support frame 12 of the roll-in cot 10 can be retracted. In some embodiments, the roll-in cot 10 can be configured to detect automatically that the support frame 12 is retracted prior to continuing with the escalator function. Alternatively or additionally, the roll-in cot 10 can be configured to automatically retract the support frame 12.

Referring collectively to FIGS. 7, 8, 11 and 13, the roll-in cot can be loaded upon the up escalator 504. The up escalator 504 can form an escalator slope (−) with respect to the landing immediately preceding the up escalator 504. At process 304, the front wheels 26 can be loaded upon the up escalator 504. Upon loading the front wheels 26 upon the up escalator 504, the raise button 60 (+) can be actuated. While the escalator function is active, the control signal transmitted from the raise button 60 (+) can be received by the one or more processors 100. In response to the control signal transmitted from the raise button 60 (+), the one or processors can execute machine readable instructions to automatically actuate the brake mechanism 94. Accordingly, the front wheels 26 can be locked to prevent the front wheels from rolling. As the raise button 60 (*f*) is held active, the one or more processors can automatically cause the visual display component provide an image indicative of the front legs 20 being active.

At process 306, the raise button 60 (+) can be held active. In response to the control signal transmitted from the raise button 60 (+), the one or processors can execute machine readable instructions to automatically activate the cot leveling function. Accordingly, the cot leveling function can dynamically actuate the front legs 20 to adjust the front angle $\alpha_f$. Thus, as the roll-in cot 10 is gradually urged onto the up escalator 504, the front angle $\alpha_f$ can be changed keep the support frame 12 substantially level.

At process 308, the raise button 60 (+) can be deactivated upon the back wheels 46 being loaded upon the up escalator 504. In response to the control signal transmitted from the raise button 60 (+), the one or processors can execute machine readable instructions to automatically actuate the brake mechanism 94. Accordingly, the back wheels 46 can be locked to prevent the back wheels 46 from rolling. With the front wheels 26 and the back wheels 46 loaded upon the up escalator 504, the cot leveling function can adjust the front angle $\alpha_f$ to match the escalator angle θ.

At process 310, the raise button 60 (+) can be activated upon the front wheels 26 approaching the end of the up escalator 504. In response to the control signal transmitted from the raise button 60 (+), the one or processors can execute machine readable instructions to automatically actuate the brake mechanism 94. Accordingly, the front wheels 26 can be unlocked to allow the front wheels 26 to roll. As the front wheels 26 exit the up escalator 504, the cot leveling function can adjust the front angle $\alpha_f$ dynamically to keep the support frame 12 of the roll-in cot 10 level.

At process 312, the position of the front legs 20 can be determined automatically by the one or more processors 100. Accordingly, as the front end 17 of the roll-in cot 10 exits the up escalator 504, the front angle $\alpha_f$ can reach a predetermined angle such as, but not limited to, an angle corresponding to full extension of the front legs 20. Upon reaching the predetermined level, the one or more processors 100 can execute machine readable instructions to automatically actuate the brake mechanism 94. Accordingly, the back wheels 46 can be unlocked to allow the back wheels 46 to roll. Thus, as the back end 19 of the roll-in cot 10 reaches the end of the up escalator 504, the roll-in cot 10 can be rolled away from the up escalator 504. In some embodiments, the escalator mode can be deactivated by actuating one of the operator controls 57. Alternatively or additionally, the escalator mode can be deactivated a predetermined time period (e.g., about 15 seconds) after the back wheels 46 are unlocked Referring collectively to FIGS. 7, 8, 12 and 13, the roll-in cot 10 can be loaded upon a down escalator 506 in a manner analogous to loading upon an up escalator 504. At process 304, the back wheels 46 can be loaded upon the down escalator 506. Upon loading the back wheels 46 upon the down escalator 506, the lower button 56 (−) can be actuated. While the escalator function is active, the control signal transmitted from the lower button 56 (−) can be received by the one or more processors 100. In response to the control signal transmitted from lower button 56 (−), the one or processors can execute machine readable instructions to automatically actuate the brake mechanism 94. Accordingly, the back wheels 46 can be locked to prevent the back wheels 46 from rolling. As the lower button 56 (−) is held active, the one or more processors can automatically cause the visual display component provide an image indicative of the front legs 20 being active.

At process 306, the lower button 56 (−) can be held active. In response to the control signal transmitted from the lower button 56 (−), the one or processors can execute machine readable instructions to automatically activate the cot leveling function. Accordingly, the cot leveling function can dynamically actuate the front legs 20 to adjust the front angle $\alpha_f$. Thus, as the roll-in cot 10 is gradually urged onto the down escalator 506, the front angle $\alpha_f$ can be changed keep the support frame 12 substantially level.

At process 308, the lower button 56 (−) can be deactivated upon the front wheels 26 being loaded upon the down escalator 506. In response to the control signal transmitted from the lower button 56 (−), the one or processors 100 can execute machine readable instructions to automatically actuate the brake mechanism 94. Accordingly, the front wheels 26 can locked to prevent the front wheels 26 from rolling. With the front wheels 26 and the back wheels 46 loaded upon the down escalator 506, the cot leveling function can adjust the front angle $\alpha_f$ to match the escalator angle θ.

At process 310, the lower button 56 (−) can be activated upon the back wheels 46 approaching the end of the down escalator 506. In response to the control signal transmitted from the lower button 56 (−), the one or processors can execute machine readable instructions to automatically actuate the brake mechanism 94. Accordingly, the back wheels 46 can be unlocked to allow the back wheels 46 to roll. As the back wheels 46 exit the down escalator 506, the cot leveling function can adjust the front angle $\alpha_f$ dynamically to keep the support frame 12 of the roll-in cot 10 substantially level.

At process 312, the position of the front legs 20 can be determined automatically by the one or more processors 100. Accordingly, as the back end 19 of the roll-in cot 10 exits the down escalator 506, the front angle $\alpha_f$ can reach a predetermined angle such as, but not limited to, an angle corresponding to full extension of the front legs 20. Upon reaching the predetermined level, the one or processors 100 can execute machine readable instructions to automatically actuate the brake mechanism 94. Accordingly, the front wheels 26 can be unlocked to allow the front wheels 26 to roll. Thus, as the front end 17 of the roll-in cot 10 reaches the end of the down escalator 506, the roll-in cot 10 can be rolled away from the down escalator 506. In some embodiments, the escalator mode can be deactivated a predetermined time period (e.g., about 15 seconds) after the front wheels 26 are unlocked.

Referring collectively to FIGS. 4B, 7, and 8, the cot functions can comprise a cardiopulmonary resuscitation (CPR) function operable to automatically adjust the roll-in cot 10 to an ergonomic position for the medical personnel to perform effective CPR in the event of a cardiac arrest. Any of the operator controls 57 can be encoded to provide control signals that are operable to cause the CPR function to be activated, deactivated, or both. In some embodiments, the CPR function can be automatically deactivated when the roll-in cot is within an ambulance, connected to a cot fastener, or both.

Upon activation of the CPR function, a control signal can be transmitted to and received by the one or more processors 100. In response to the control signal, the one or processors can execute machine readable instructions to automatically actuate the brake mechanism 94. Accordingly, the front wheels 26, the back wheels 46, or both can be locked to prevent the roll-in cot 10 from rolling. The roll-in cot 10 can be configured to provide an audible indication that the CPR function has been activated. Additionally, the height of the support frame 12 of the roll-in cot 10 can be slowly adjusted to an intermediate transport position (FIG. 4B) corresponding to a substantially level height for administering CPR such as, for example, a chair height, a couch height, between about 12 inches (about 30.5 cm) and about 36 inches (about 91.4 cm), or any other predetermined height suitable for administering CPR. In some embodiments, one or more of the operator controls 57 can be configured to lock or unlock the front wheels 26, the back wheels 46, or both. Actuating the operator controls 57 to lock or unlock the front wheels 26, the back wheels 46, or both, can automatically deactivate the CPR function. Accordingly, normal operation of the roll-in cot 10 via the lower button 56 (–) and the raise button 60 (+) can be restored.

Referring collectively to FIGS. 3, 7, and 8, the cot functions can comprise a extracorporeal membrane oxygenation (ECMO) function operable to automatically maintain the front end 17 at a higher elevation than the back end 19 of the roll-in cot 10 during operation of the roll-in cot 10. Upon activation of the ECMO function, a control signal can be transmitted to and received by the one or more processors 100. In response to the control signal, the one or processors 100 can execute machine readable instructions to automatically actuate the lock actuator 92. Accordingly, the front wheels 26, the back wheels 46, or both can be prevented from swiveling or turning. Additionally, the front angle $\alpha_f$, the back angle $\alpha_b$, or both can be adjusted such that the support frame 12 is at a predetermined downward slope angle from the front end 17 to the back end 19. The adjustment can be achieved in a manner substantially similar to the cot leveling function, with the exception that the support frame 12 is adjusted to the downward slope angle with respect to gravity, instead of level with respect to gravity. Moreover, while the ECMO function is activated, the lower button 56 (–) and the raise button 60 (+) can be utilized to adjust the average height of the support frame 12 while the downward slope angle is maintained automatically. Upon deactivation of the ECMO function, normal operation of the roll-in cot 10 can be restored.

It should now be understood that the embodiments described herein may be utilized to transport patients of various sizes by coupling a support surface such as a patient support surface to the support frame. For example, a lift-off stretcher or an incubator may be removably coupled to the support frame. Therefore, the embodiments described herein may be utilized to load and transport patients ranging from infants to bariatric patients. Furthermore the embodiments described herein, may be loaded onto and/or unloaded from an ambulance by an operator operating simple controls to actuate the independently articulating legs (e.g., pressing the lower button (–) to load the cot onto an ambulance or pressing the raise button (+) to unload the cot from an ambulance). Specifically, the roll-in cot may receive an input signal such as from the operator controls. The input signal may be indicative a first direction or a second direction (lower or raise). The pair of front legs and the pair of back legs may be lowered independently when the signal is indicative of the first direction or may be raised independently when the signal is indicative of the second direction.

It is further noted that terms like "preferably," "generally," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

For the purposes of describing and defining the present disclosure it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having provided reference to specific embodiments, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of any specific embodiment.

The invention claimed is:

1. A method of automatically articulating a powered ambulance cot to transport a patient up or down a moving escalator, comprising:

supporting the patient on a powered ambulance cot, said cot comprises a support frame provided with a pair of front load wheels and supporting the patient, a pair of front legs each having a front wheel and an intermediate load wheel, a pair of back legs each having a back wheel, a cot actuation system having a front actuator which moves together the pair of front legs and which interconnects the support frame and the pair of front legs, and a back actuator which moves together the pair of back legs and which interconnects the support frame and the pair of back legs, and a cot control system operably connected to the cot actuation system to control raising and lowering of the pair of front legs and the pair of back legs independently, and which detects a presence of a signal requesting a change in elevation of said support frame to cause the cot actuation system to move either or both pairs of the front and back wheels relative to the support frame via the raising or the lowering of the pair of front legs and/or the pair of back legs; and rolling the cot onto the moving escalator, wherein the control system automatically retracts or extends the front legs to maintain the support frame level relative to gravity as the escalator moves up or down.

2. The method according to claim 1 wherein the cot control system is operably connected to a brake mechanism associated with each of the front and back wheels, said brake mechanism when activated prevents rolling of a respective wheel, and said method comprises automatically actuating via the cot control system the brake mechanism of each of the front and back wheels as the cot is moving up or down the escalator.

3. The method according to claim 1, wherein the cot control system is operably connected to an operator control which provides a signal when actuated which indicates activation of an escalator function, and the method comprises actuating the operator control before or upon rolling the cot onto the moving escalator to cause the control system to automatically retract or extend the front legs to maintain the support frame level relative to gravity as the escalator moves up or down.

4. The method according to claim 1, wherein the cot control system is operably connected to a brake mechanism associated with each of the front and back wheels, said brake mechanism when activated prevents rolling of a respective wheel, and operably connected to a cardiopulmonary resuscitation (CPR) operator control which provides a signal when actuated which indicates activation of a CPR function which adjusts the cot to an ergonomic position to perform effective CPR, and the method comprises actuating the CPR operator control to cause the control system to automatically retract the back legs and extends the front legs to adjust the cot to the ergonomic position to perform effective CPR and activate the brake mechanism associated with each of the front and back wheels.

5. The method according to claim 1, wherein the cot control system is operably connected to an extracorporeal membrane oxygenation (ECMO) operator control which provides a signal when actuated which indicates activation of a ECMO function which maintains a front end of the cot at a higher elevation than a back end of the cot during operation of the cot, and the method comprises actuating the ECMO operator control to cause the control system to automatically retract or extend the back legs and automatically retract or extends the front legs to maintain the front end of the cot at a higher elevation than the back end of the cot.

6. The according to claim 1, wherein the cot control system is operably connected to a display, and said method comprises displaying a visual indication of a current position of the front legs and back legs and color-coded to show activated legs in a first color and non-activated legs in a second color.

7. The method according to claim 1, wherein the cot control system is operably connected to a gravitational reference sensor configured to provide a gravitational reference signal indicative of an earth frame of reference, and said method comprises said cot control system using said gravitational reference sensor to maintain the support frame level relative to gravity.

* * * * *